US011339575B2

(12) United States Patent
Eves et al.

(10) Patent No.: US 11,339,575 B2
(45) Date of Patent: May 24, 2022

(54) HAND RAILS

(71) Applicant: PIPEX LIMITED, Plymouth (GB)

(72) Inventors: Simon Eves, Glasgow (GB); Matthew John Hewstone, Exeter (GB)

(73) Assignee: PIPEX LIMITED, Plymouth (GB)

( * ) Notice: Subject to any disclaimer, the term of this patent is extended or adjusted under 35 U.S.C. 154(b) by 337 days.

(21) Appl. No.: 16/241,482

(22) Filed: Jan. 7, 2019

(65) Prior Publication Data

US 2019/0136540 A1 May 9, 2019

Related U.S. Application Data

(63) Continuation of application No. 13/577,837, filed as application No. PCT/GB2011/000137 on Feb. 2, 2011, now abandoned.

(30) Foreign Application Priority Data

Feb. 8, 2010 (GB) ..... 1002004

(51) Int. Cl.
*E04F 11/18* (2006.01)

(52) U.S. Cl.
CPC ..... *E04F 11/1834* (2013.01); *E04F 11/1836* (2013.01); *E04F 2011/1821* (2013.01); *E04F 2011/1897* (2013.01)

(58) Field of Classification Search
CPC ..... E04F 11/1834; E04F 11/1836; E04F 2011/1819; E04F 2011/1821
See application file for complete search history.

(56) References Cited

U.S. PATENT DOCUMENTS

| | | | |
|---|---|---|---|
| 3,004,751 | A | 10/1961 | Woodward |
| 3,532,369 | A | 10/1970 | Reilly |
| 3,851,980 | A | 12/1974 | Worth et al. |
| 3,873,220 | A | 3/1975 | Kashiwabara |
| 4,053,140 | A | 10/1977 | Clemens et al. |

(Continued)

FOREIGN PATENT DOCUMENTS

| | | | |
|---|---|---|---|
| CN | 201184023 | Y | 1/2009 |
| DE | 3342668 | A | 6/1985 |

(Continued)

OTHER PUBLICATIONS

Jul. 12, 2011—International Search Report—App PCT/GB2011/000137); ISA/EP.

(Continued)

*Primary Examiner* — Michael P Ferguson
(74) *Attorney, Agent, or Firm* — Banner & Witcoff, Ltd.

(57) ABSTRACT

A handrail system includes a top rail and one or more support posts. The rail and post/s may be formed from a synthetic material such as a fibre reinforced plastics material. The or each connector has a rail connection part for connection to a rail section at either end thereof and a post connection part for connection to a support post, the connector forming part of the top rail whereby a continuous top rail is provided, in which the connection of the post/s to the connector/s is articulated so that in use the rail slope is adjustable. The system also includes one or more adjustable corner connectors including first and second parts hingedly connected to each other and being attachable to a rail section and a support post or leg.

19 Claims, 20 Drawing Sheets

(56) References Cited

U.S. PATENT DOCUMENTS

| | | | | |
|---|---|---|---|---|
| 4,477,059 | A * | 10/1984 | Willis | E04H 17/1413 256/65.11 |
| 4,480,819 | A | 11/1984 | Lopez | |
| 4,540,160 | A | 9/1985 | Zanavich et al. | |
| 4,770,560 | A | 9/1988 | Ott | |
| D311,680 | S | 10/1990 | Miall | |
| 5,312,089 | A * | 5/1994 | Venegas, Jr. | E04H 17/1413 256/65.12 |
| 5,451,115 | A | 9/1995 | Sayres | |
| 5,529,289 | A | 6/1996 | Lancer, Sr. | |
| 6,290,213 | B1 | 9/2001 | Laird et al. | |
| 6,588,334 | B2 | 7/2003 | Salisbury | |
| 6,662,515 | B2 | 12/2003 | Buhrts et al. | |
| 7,077,386 | B1 | 7/2006 | Gray, Jr. et al. | |
| 7,540,472 | B2 | 6/2009 | Striebel et al. | |
| 7,913,960 | B1 | 3/2011 | Herr, III et al. | |
| 2003/0079417 | A1 | 5/2003 | Bonin | |
| 2003/0164488 | A1 | 9/2003 | Terrels | |
| 2004/0009338 | A1 | 1/2004 | Jo et al. | |
| 2008/0173857 | A1 | 7/2008 | Edwards | |
| 2008/0277640 | A1 | 11/2008 | Striebel et al. | |
| 2009/0032792 | A1 | 2/2009 | Ford et al. | |
| 2009/0179183 | A1 | 7/2009 | Ferris et al. | |

FOREIGN PATENT DOCUMENTS

| | | | |
|---|---|---|---|
| DE | 19936126 | A1 | 2/2001 |
| DE | 102009003753 | A1 | 10/2010 |
| EP | 1878865 | A | 1/2008 |
| GB | 2272006 | A | 5/1994 |
| GB | 2299370 | A | 10/1996 |
| GB | 2411910 | A | 9/2005 |
| GB | 2444928 | A | 6/2008 |
| GB | 2461383 | A | 1/2010 |
| JP | 2003-027687 | A | 1/2003 |
| JP | 2003213872 | A | 7/2003 |
| JP | 2005-083010 | A | 3/2005 |
| JP | 2006-124971 | A | 5/2006 |
| KR | 20-0340325 | Y1 | 2/2004 |

OTHER PUBLICATIONS

Mar. 25, 2011—(GB) IPO Search Report—App GB1101826.4.
Mar. 25, 2011—(GB) IPO Search Report—App GB1101828.0.
May 20, 2010—(GB) IPO Search Report—App GB1002004.8.
Mar. 29, 2011—(GB) IPO Search Report—App GB1101830.6.
Mar. 30, 2011—(GB) IPO Search Report—App GB1101826.4.
https:/lweb.archive.org/web/20060311091427/http:/lwww.sdplastics.com/SAFRAIL <http://www.sdplastics.com/SAFRAIL>Brochure1004.pdf.

* cited by examiner

HAND RAILS

CROSS-REFERENCE TO RELATED APPLICATIONS

The present application is a continuation of U.S. patent application Ser. No. 13/577,837, filed Sep. 17, 2012, which is a U.S. National Phase filing of International Application No. PCT/GB2011/000137, filed on Feb. 2, 2011, designating the United States of America and claiming priority to United Kingdom Patent Application No. 1002004.8, filed Feb. 8, 2010, and the present application claims priority to and the benefit of all the above-identified applications, which are all incorporated by reference herein in their entireties.

TECHNICAL FIELD

The present invention relates generally to hand rails and particularly to aspects of safety, production and assembly of, and connections of, hand rails.

BACKGROUND

Hand rail structures are used in a wide range of circumstances and for a variety of reasons. For example, hand rail structures may be deployed along staircases or walkways to serve as a support for people as they move. Alternatively or additionally hand rail systems can be used as barriers or "fences" to delimit an area.

There are a variety of considerations when designing a hand rail system, primarily safety aspects but also material choice, production techniques and ease of assembly which will influence the properties and performance of the resulting structure that is in turn dictated by, for example, the final application (such as offshore installations).

BRIEF SUMMARY

The present invention seeks to provide improvements in or relating to hand rail systems.

According to a first aspect of the present invention there is provided a handrail system comprising a top rail and one or more support posts, in which the rail and post/s are formed from a synthetic material.

The material from which the hand rail system is produced is an important consideration. The material from which all of the components of the hand rail system may be the same or, depending on the circumstances may be different.

The synthetic material may comprise a composite material such as an advanced composite. For example, the material may comprise a reinforced composite material such as a fibre-reinforced plastic (FRP) material, which is a composite material of fibre glass (or other fibre) in a polymer matrix. FRP is seen as a particularly suitable material from which to form the hand rail structures of the present invention. FRP combines low weight with high strength and provides corrosion resistance and excellent thermal and electrical insulation. Because FRP materials have low thermal conductivity they can have particular benefits when used in cold weather conditions, where they are "warm" to the touch. Other advantageous properties may include low electrical conductivity and electromagnetic transparency.

The FRP material can be selected on the basis of required properties for the resulting hand rail systems, for example polyester-, epoxy-, and vinyl ester-based materials. For example phenolic-based FRP materials can be used. Other suitable component materials may include bioresins and natural fibres to form a reinforced composite material.

Phenolic-based FRP materials have presented significant difficulties in production, for example, by pultrusion. However, the inventors have surprisingly found that phenolic-FRP can be used to form hand rail structures which have particularly good fire-resistance properties. Phenolic-based FRP hand rails may have particular benefits for off shore applications, such as oil rigs.

The material may be provided in various forms for production (for example by moulding) such as sheet moulding compound (SMC) or dough moulding compound (DMC).

The connection of the post to the rail may be articulated so that, in use, the rail slope is adjustable. This allows, for example, posts to stay generally vertical whilst the rail can be used for level and sloping applications.

The rail may comprise one or more sockets for receiving respective posts. The post is therefore fitted into the rail interior which removes the need for an external bracket. The articulation part of the joint can thereby be hidden in the top rail moulding. This minimises the trapping risk presented by the rail in use because and allows the rail to be constructed with no sharp corners which might, for example, allow loose clothing to get caught.

The system may comprise connectors for receiving the post/s and for receiving rail sections. The connector may be arranged to receive a rail section at either end thereof and to receive the post on its underside (in use).

The connector may comprise a post joint portion hingedly connected to a rail body portion. The joint portion therefore serves as a connector between the rail and the main post structure, with the rail body portion effectively forming an integral part of the rail.

The post joint portion may comprise a post adapter receivable in the rail portion and connectable to a support post.

The post may be connected to the rail by a hinge pin. The hinge pin permits articulation of the post and rail with respect to each other.

The rail and post/s may have square cut ends. Simple square cut ends make accurate fabrication simpler and generally give a better quality finish. Configuring the hand rail system so that no sloping cuts or mitre joints are required gives significant production and assembly benefits.

According to the present invention there is also provided a handrail system comprising a top rail and one or more support posts connected to the rail, in which the or each post-rail connection region is adapted to permit a user to maintain a continuous grip of the rail during a sliding movement across the region.

This allows provision of a handrail system in which the entire handrail can be gripped i.e. uninterrupted grip can be obtained along the rail rather than having to release grip across post-rail connection regions.

In known hand rail systems it is usual for posts to connect to the top rail with cumbersome brackets which are of a size, shape and position which forces a user to remove their hand from the hand rail and pass over the bracket to the other side before they can replace their hand. The provision of a "continuous" top rail is an important safety and ergonomic feature. This allows a hand to hold the rail and slide it along continuously as someone is walking. This means that as a person is walking besides the hand rail they do not have to take their hand off. The provision of a continuous hand grip/contact area which is unencumbered by post-rail connections is an important safety feature because the user can be in continual gripping contact with the top rail. This would be particularly important, for example, in the event of a fire or other emergency in which visibility is impaired so that the user can feel their way along the hand rail with no interruptions.

According to a further aspect of the present invention there is provided a handrail system comprising a generally cylindrical top rail and one or more support posts connected to the rail, in which the circumferential area of the rail occupied by the or each post at respective post-rail interfaces is less than the diameter of the rail.

By providing a post-rail interface with a reduced circumferential extent a user is able to grip the rail across the interface.

The area occupied by the or each post may be less than half the diameter of the rail.

The unoccupied circumference of the rail may be in the range of 110 mm to 200 mm at the or each post-rail interface. The unoccupied circumference of the rail may be at least 124 mm at the or each post-rail interface. In an alternative interpretation of the invention the unoccupied circumference may be determined as a value equating to a circular sector i.e. the post occupies an included arc. For example, the post may occupy a sector in the range of 10 degrees to 180 degrees, for example in the ranges of 30 to 120 degrees or 40 to 60 degrees, such as approximately 50 degrees.

Other rail sections may be used, such as elliptical or square with round corners.

Rails without protrusions and with a generally smooth surface may be preferred.

According to a further aspect of the present invention there is provided a handrail system comprising a top rail and one or more support posts connected to the rail in which the or each post-rail connection interface provides a grip zone so that a user can grip the rail across the interface.

According to a further aspect of the present invention there is provided a hand rail system comprising a top rail and one or more support posts, in which the effective hand grip area of the rail is substantially continuous whereby to provide uninterrupted support along the length of the rail.

The post-rail interface may be facilitated by a connector which can receive one or more rail sections and connect (directly or indirectly) to a support post. The system may therefore comprise connectors for receiving the post/s and for receiving rail sections. The connector may be arranged to receive a rail section at either end thereof and to receive the post on its underside (in use).

The connector may comprise a main body part which both forms part of the top rail and receives a support post in use.

The top rail connection part may comprise a projection or recess for engaging a corresponding recess or projection on a rail section.

The rail connection part may be adapted to be flush fitting with a rail section.

The post connector may include a post adapter received in the connector and being connectable to a support post. The post adapter may be hingedly received.

The post connection part of the rail may comprise a socket for receiving part of a post or a post adapter internally. The rail (or rail connector part) may therefore comprise one or more sockets for receiving respective posts (or post adapters). The post is therefore fitted into the rail interior which removes the need for an external bracket. The articulation part of the joint can thereby be hidden in the top rail moulding. This minimises the trapping risk presented by the rail in use because and allows the rail to be constructed with no sharp corners which might, for example, allow loose clothing to get caught.

The post connection part may form a hinging joint with the support post. This means that, in use, the top rail and/or support post can be inclined to accommodate different surfaces. The or each post may be connected to the rail by an articulated joint, in which the joint is provided inside the rail. In other words, the joint is a discreet connection with the articulation part of the joint hidden in the top rail. The post and rail can be moved with respect to each other prior to fixing in position and thereafter provides an unobtrusive joint.

The connector may be adapted to form an integral part of the top rail structure. In some embodiments part of the connector effectively forms an intermediate top rail section so that the top rail is not interrupted by the connector.

The connection of the post to the rail may be articulated so that, in use, the rail slope is adjustable. This allows, for example, posts to stay generally vertical whilst the rail can be used for level and sloping applications.

The connector may comprise a post joint portion hingedly connected to a rail body portion. The joint portion therefore serves as a connector between the rail and the main post structure, with the rail body portion effectively forming an integral part of the rail.

The post may be connected to the rail by a hinge pin. The hinge pin permits articulation of the post and rail with respect to each other.

The rail and post/s may have square cut ends. Simple square cut ends make accurate fabrication simpler and generally give a better quality finish. Configuring the hand rail system so that no sloping cuts or mitre joints are required gives significant production and assembly benefits.

According to a further aspect of the present invention there is provided a handrail connector comprising a top rail connection part attachable to one or more top rail sections and a post connection part attached or attachable to a support post, in which the post connection part is articulated with respect to the rail connection part.

This means that, in use, the top rail and/or support post can be inclined to accommodate different underlying surfaces/slopes.

The connector may comprise a main body part which both forms part of the top rail and receives a support post in use.

The top rail connection part may comprise a projection or recess for engaging a corresponding recess or projection on a rail section.

The rail connection part may be adapted to be flush fitting with a rail section.

The post connection part may comprise a socket for receiving part of a post internally.

The post connection part may be formed separately from the rail connection part.

The post connection part may form a joint with the rail connection part. The joint between the rail connection part and the post connection part may be made inside the rail connection part.

The post connection part may form a hinging joint with a, or for a, support post. This means that, in use, the top rail and/or support post can be inclined to accommodate different surfaces.

The post connector may include a post adapter received in the connector and being connectable to a support post. The post adapter may be hingedly received.

The connector may be adapted to form an integral part of the top rail structure. In some embodiments part of the connector effectively forms an intermediate top rail section so that the top rail is not interrupted by the connector.

The post connection part may be connected to the rail connection part by a hinge pin. The hinge pin permits articulation of the post and rail with respect to each other.

The connector may be generally T-shape.

The post and rail connector parts may be formed integrally with a post/rail, or may be formed separately and with some means of a stable connection to a post/rail.

According to a further aspect of the present invention there is provided a handrail system comprising one or more top rail sections, one or more support posts and one or more connectors as described herein.

According to a further aspect there is provided an adjustable hand rail corner connector part hingedly connectable to another such part and being attachable to further hand rail components, in which the part comprises a cranked portion.

The crank angle may be in the range of 15° and 30° and in some embodiments is approximately 22.5°.

The first and second parts of a connector may be substantially the same. This results in substantial cost savings with two parts that can be produced in the same mould.

The material from which the hand rail system is produced is an important consideration. The material from which all of the components of the hand rail system may be the same or, depending on the circumstances may be different.

Components may, for example, be formed from a synthetic material. The synthetic material may comprise a composite material such as an advanced composite. For example, the material may comprise a reinforced composite material such as a fibre-reinforced plastic (FRP) material, which is a composite material of fibre glass (or other fibre) in a polymer matrix. FRP is seen as a particularly suitable material from which to form the hand rail structures of the present invention. FRP combines low weight with high strength and provides corrosion resistance and excellent thermal and electrical insulation. Because FRP materials have low thermal conductivity they can have particular benefits when used in cold weather conditions, where they are "warm" to the touch. Other advantageous properties may include low electrical conductivity and electromagnetic transparency.

The FRP material can be selected on the basis of required properties for the resulting hand rail systems, for example polyester-, epoxy-, and vinyl ester-based materials. For example phenolic-based FRP materials can be used. Other suitable component materials may include bioresins and natural fibres to form a reinforced composite material.

Phenolic-based FRP materials have presented significant difficulties in production, for example, by pultrusion. However, the inventors have surprisingly found that phenolic-FRP can be used to form hand rail structures which have particularly good fire-resistance properties. Phenolic-based FRP hand rails may have particular benefits for off shore applications, such as oil rigs.

The material may be provided in various forms for production (for example by moulding) such as sheet moulding compound (SMC) or dough moulding compound (DMC).

According to a further aspect of the present invention there is provided a hand rail system as described herein in combination with a corner connector as described herein.

All combinations of the different aspects and embodiments are envisaged.

BRIEF DESCRIPTION OF THE DRAWINGS

The present invention will now be more particularly described, by way of example, with reference to the accompanying drawings, in which.

DETAILED DESCRIPTION

Figure 1:
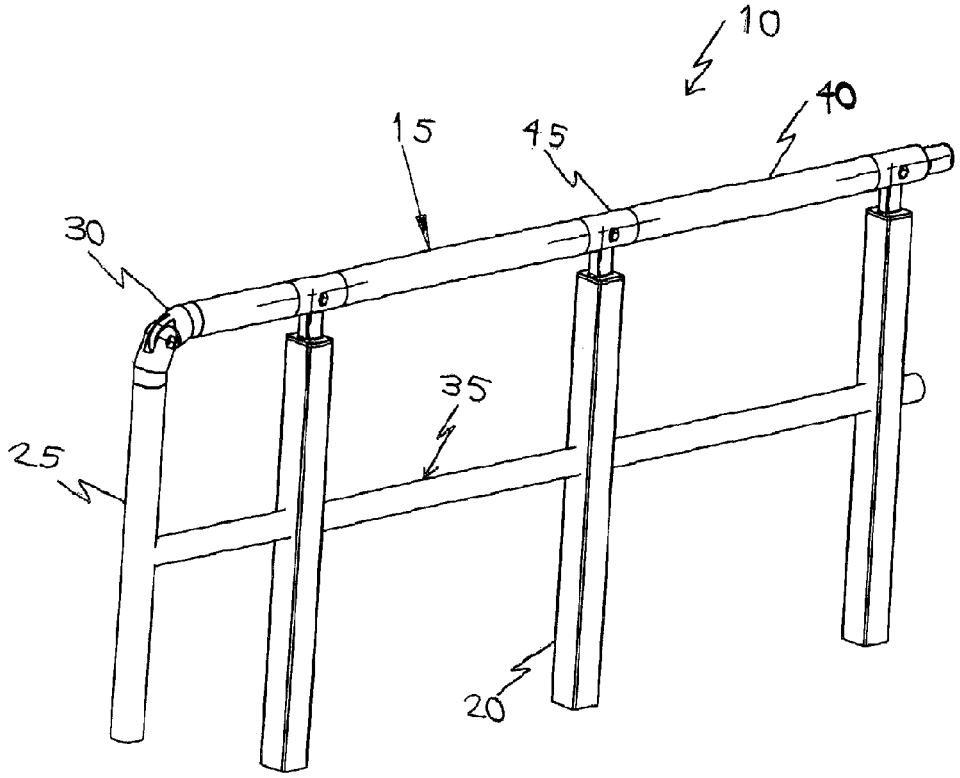
FIG. 1 is a perspective view of a hand rail arrangement formed according to an aspect of the present invention.
Figure 2:
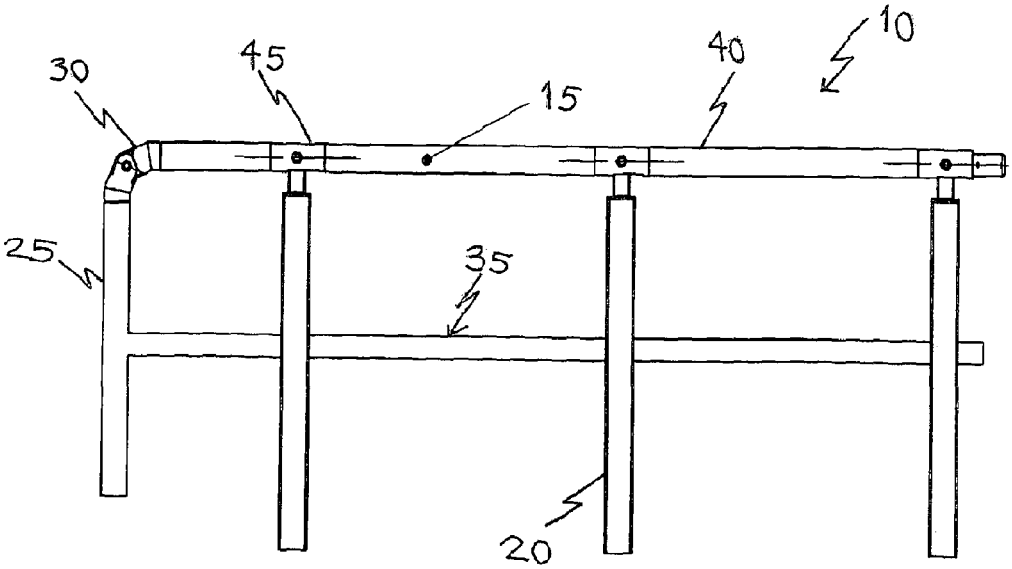
FIG. 2 is a side view of the arrangement of FIG. 1.

Referring first to FIGS. 1 and 2 there is shown a hand rail system generally indicated 10. The system 10 comprises a rectilinear top rail 15 and a plurality (in this case three are shown) of depending support posts 20. At one end of the rail 15 a support leg 25 is connected orthogonally by an articulating connector 30. A cross member 35 extends parallel to the top rail 15 from the leg 25 through the posts 20; in some embodiments the cross member 25 may comprise a plurality of sections extending between adjacent posts and between the leg 25 and the adjacent post 20.

The top rail 15 is of generally cylindrical shape with a circular cross section and is formed from an FRP material. The rail 15 is made up of a number of rail sections 40 which are joined by connectors 45 which also receive the post 20 as described in more detail below. Each post 20 is received on the underside of the connector 45 and the connectors 45 are the same diameter as the sections 40. This means that the connector 45 provides a surface which can itself be gripped by a user and the interface between the connector 45 and the adjacent rail sections 40 is such that a user does not need to remove their hand to pass over the intersections. Accordingly, the rail 15 presents a substantially continuous gripping surface along its length.

Figure 3:
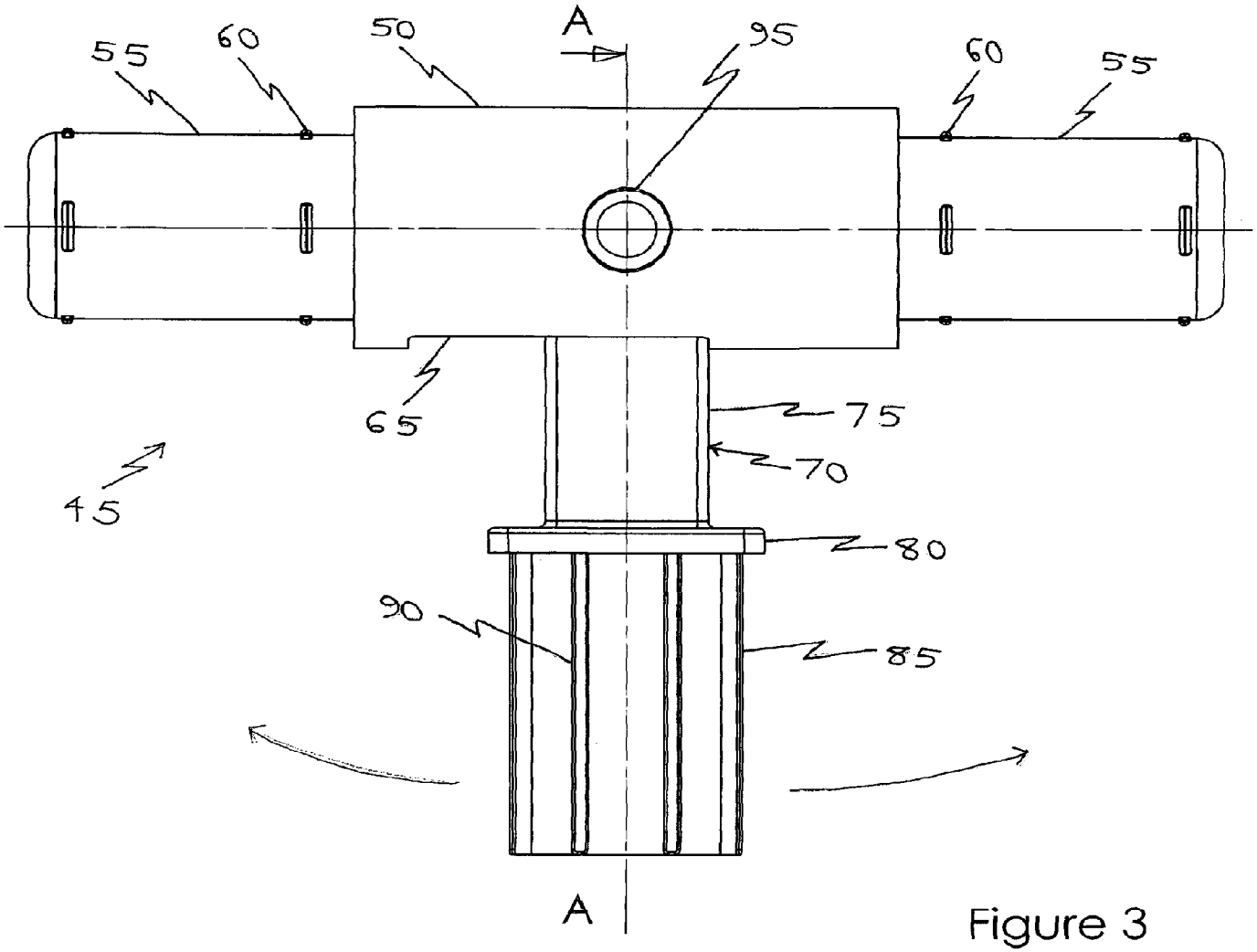
FIG. 3 is a side view of a post-to-rail connector forming part of the arrangement of FIGS. 1 and 2.

Referring now to FIG. 3 the post-to-rail connector 45 is shown in more detail.

The connector 45 is generally T-shape and comprises a rail connector section and a post connector section. The rail connector section comprises a central body 50 having at either end a cylindrical dowel portion 55. The dowel portions 55 are dimensioned to fit tightly within the ends of rail sections 40 and each dowel 55 is provided with ribs 60 on their outer surfaces to centralise the fit to ensure a consistent adhesive line thickness.

The central section 50 includes a socket 65 having a generally rectangular cross section.

The socket 65 receives a post connector 70 which comprises an articulation leg 75 received in the socket 65 which extends to a post cap 80 from which depends a fixing section 85. The fixing section 85 has a generally square cross section and is provided on its external surface with a plurality of longitudinal ribs 90. The section 85 is received in the top of a post 20 and pushed in until the cap 80 abuts against the end of the post 20.

The rail sections 40 are pushed onto the dowels 55 until they abut against the central section 50. The central section 50 has the same cross section and diameter as the rail sections 40 so that there is a flush fit at the intersections.

The central section 50 is provided with a pin hole 95 and the leg 75 is also provided with a pin hole 100. The holes 95, 100 are aligned and a hinge pin 105 is passed through to join the leg 75 to the body 50 in a hinging joint. This means that the joint between the body 50 and the legs 75 is articulated so that in use the angle between posts and the hand rail can be varied to accommodate different situations.

Figure 4:
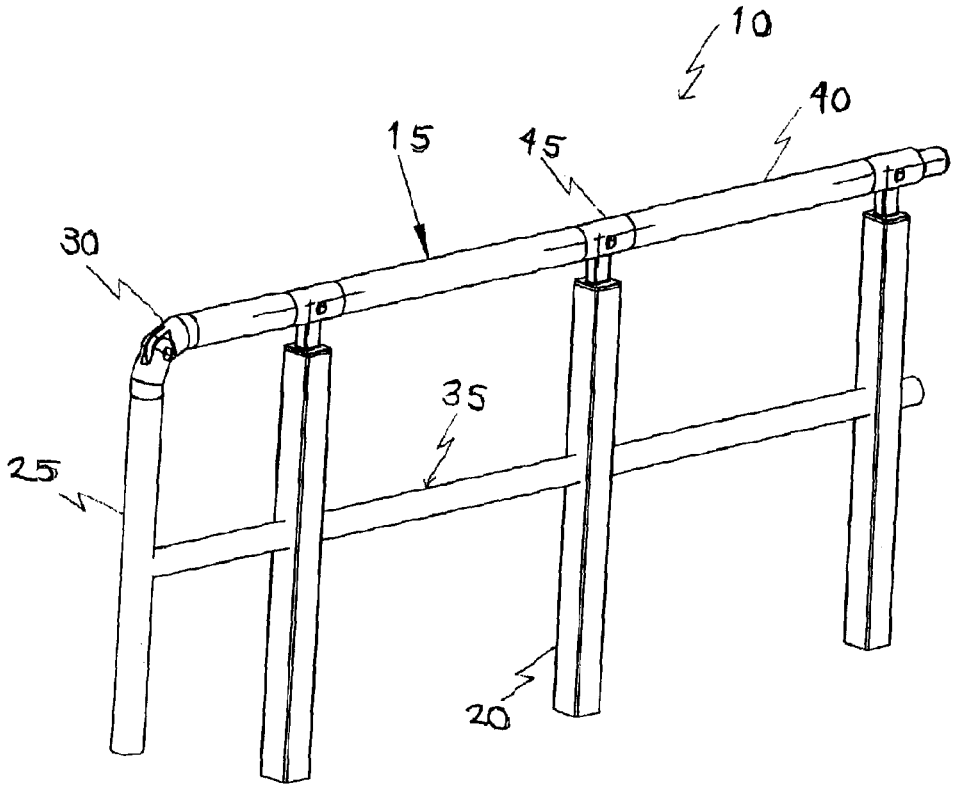
FIG. 4 is a perspective view of a hand rail arrangement formed according to an alternative aspect of the present invention.
Figure 5:
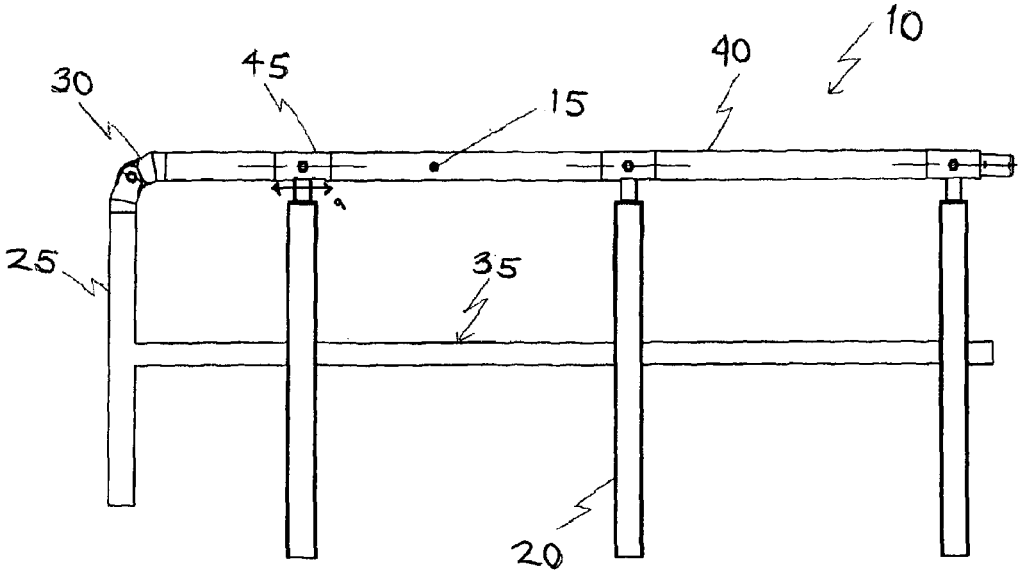
FIG. 5 is a side view of the arrangement of FIG. 4.
Figure 7:
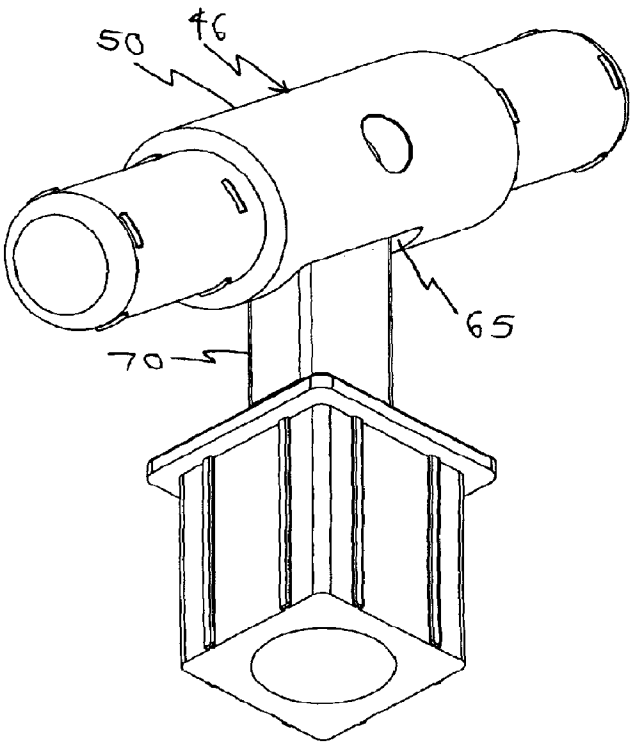
FIG. 7 is a perspective view of the connector of FIG. 6.
Figure 6:
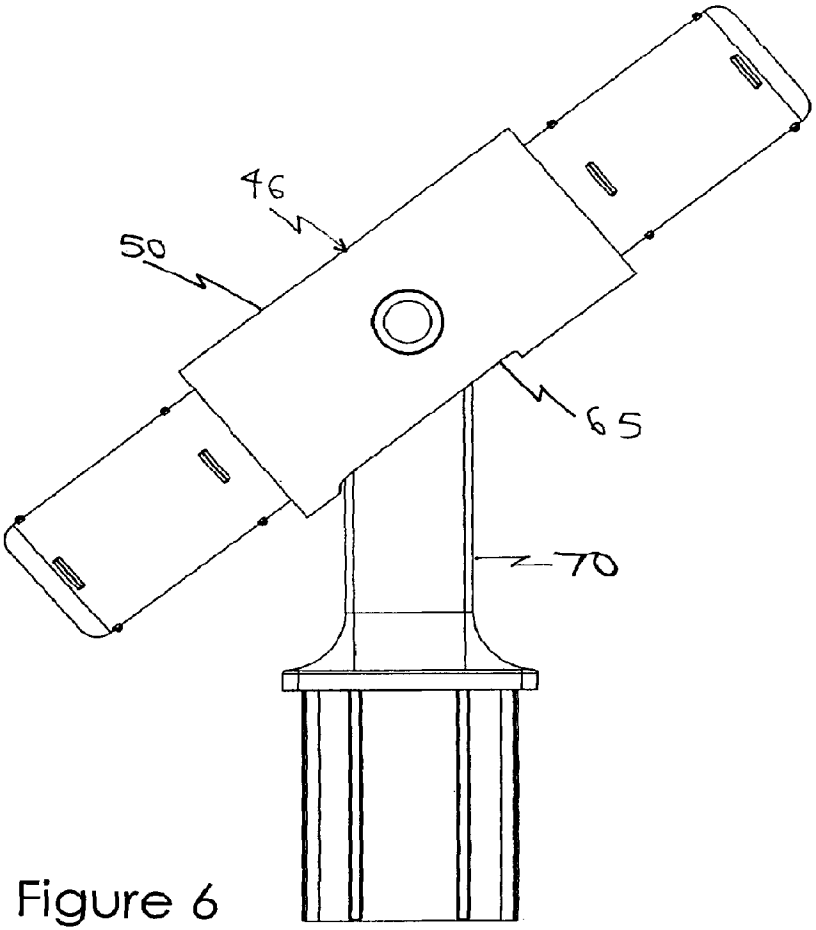
FIG. 6 is a side view of a post-rail connector forming part of the arrangement of FIGS. 1 and 2 with the connector in an inclined position.
Figure 8:
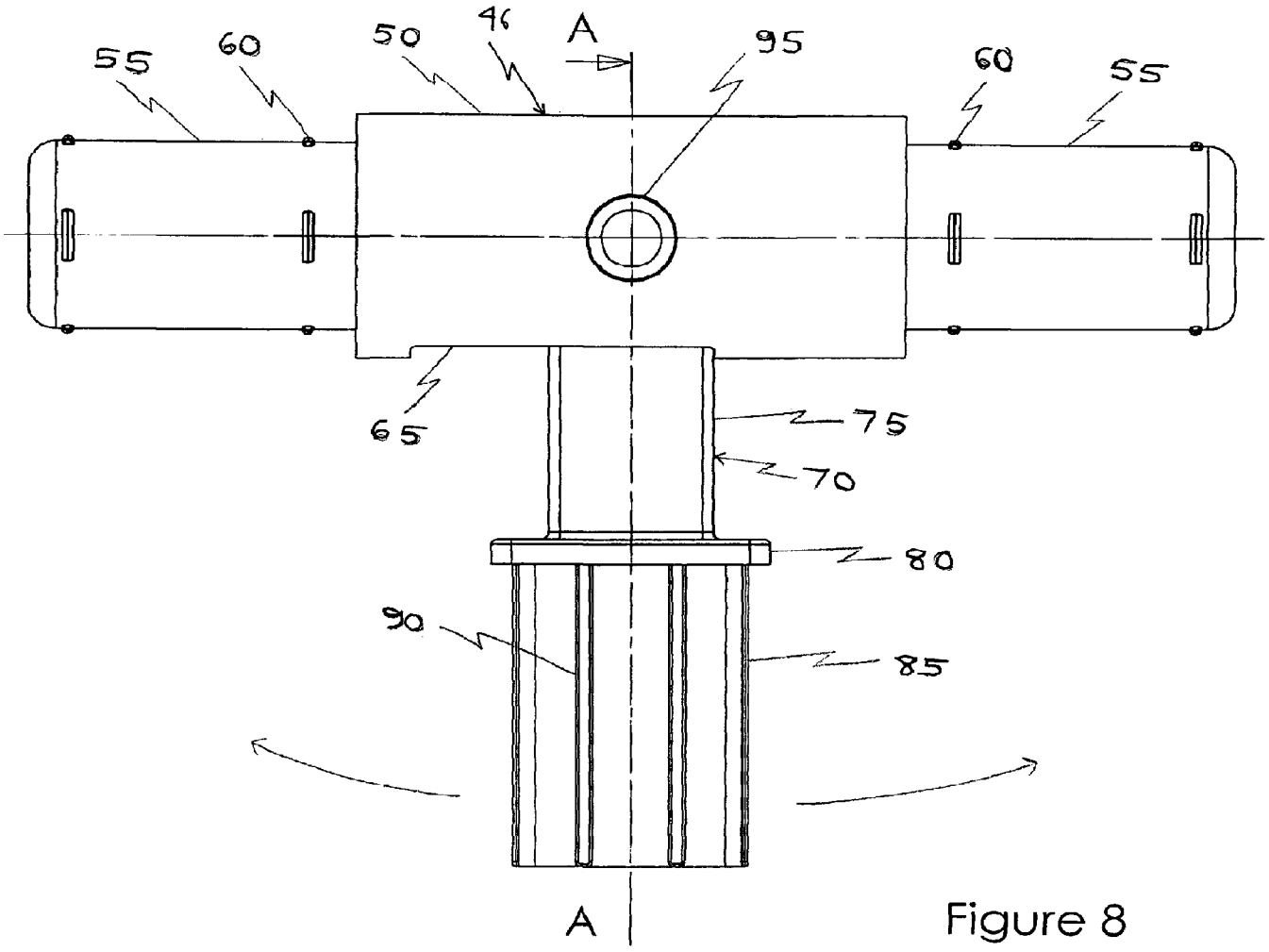
FIG. 8 is a side view of the connector of FIGS. 6 and 7 shown in a straight position.

Referring now to FIGS. 4 and 5 there is shown a hand rail system generally indicated 10 formed according to an alternative aspect. The system 10 comprises a rectilinear top rail 15 and a plurality (in this case three are shown) of depending support posts 20. At one end of the rail 15 a support leg 25 is connected orthogonally by an articulating connector 30. A cross member 35 extends parallel to the top rail 15 from the leg 25 through the posts 20; in some embodiments the cross member 25 may comprise a plurality of sections extending between adjacent posts and between the leg 25 and the adjacent post 20.

The top rail 15 is of generally cylindrical shape with a circular cross section. The rail 15 is made up of a number of rail sections 40 which are joined by connectors 45 which include a post adapter 70 so that they also receive the post 20 as described in more detail below. Each post 20 is received on the underside of the connector 45. The connectors 45 are the same diameter as the sections 40 and the interface region (a) between the post and the rail (described in more detail below) means that the connector 45 provides a surface which can itself be gripped by a user and the interface between the connector 45 and the adjacent rail sections 40 is such that a user does not need to remove their hand to pass over the intersections. Accordingly, the rail 15 presents a substantially continuous gripping surface along its length.

Referring now to FIGS. 6 to 9 the post-to-rail joint region is shown in more detail.

The connector 45 is generally T-shape and comprises a rail connector section 46 and a post connector section 70. The rail connector section 46 comprises a central body 50 having at either end a cylindrical dowel portion 55. The dowel portions 55 are dimensioned to fit tightly within the ends of rail sections 40 and each dowel 55 is provided with ribs 60 on their outer surfaces to centralise the fit to ensure a consistent adhesive line thickness.

The central section 50 includes a socket 65 having a generally rectangular cross section.

The socket 65 receives a post connector 70 which comprises an articulation leg 75 received in the socket 65 which extends to a post cap 80 from which depends a fixing section 85. The fixing section 85 has a generally square cross section and is provided on its external surface with a plurality of longitudinal ribs 90. The section 85 is received in the top of a post 20 and pushed in until the cap 80 abuts against the end of the post 20.

The rail sections 40 are pushed onto the dowels 55 until they abut against the central section 50. The central section 50 has the same cross section and diameter as the rail sections 40 so that there is a flush fit at the intersections.

The central section 50 is provided with a pin hole 95 and the leg 75 is also provided with a pin hole 100. The holes 95, 100 are aligned and a hinge pin 105 is passed through to join the leg 75 to the body 50 in a hinging joint. This means that the joint between the body 50 and the legs 75 is articulated so that in use the angle between posts and the hand rail can be varied (see FIGS. 3 and 5, for example) to accommodate different situations.

Figure 9:
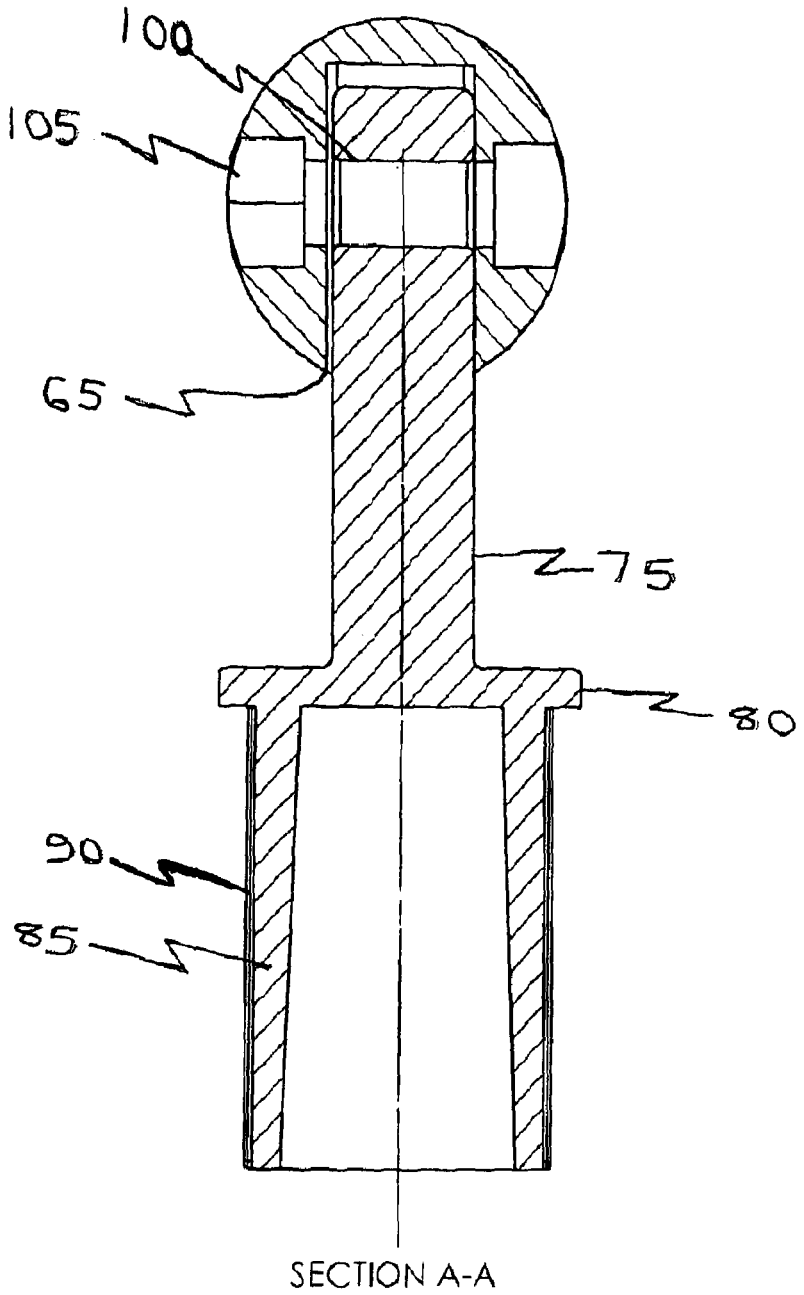
FIG. 9 is a section of the connector of FIG. 8 taken along line A-A.

As shown best in FIG. 9, the circumferential length of the body 50 occupied by the leg 75 is less than half the diameter of the body. This means that a user can still grip around the body across the post-rail interface. In other words, the circumference of the rail (provided by the body) at the post-rail interface is sufficient for a user to grip around so that the rail can provide uninterrupted grip across the interface.

In other embodiments (not shown) the post may be fixed directly to the rail or form an integral part thereof and/or there may be no hinging joint. However, the relationship between extent to which the post occupies the rail is still restricted so that grip can be maintained at the interface.

Figure 10:
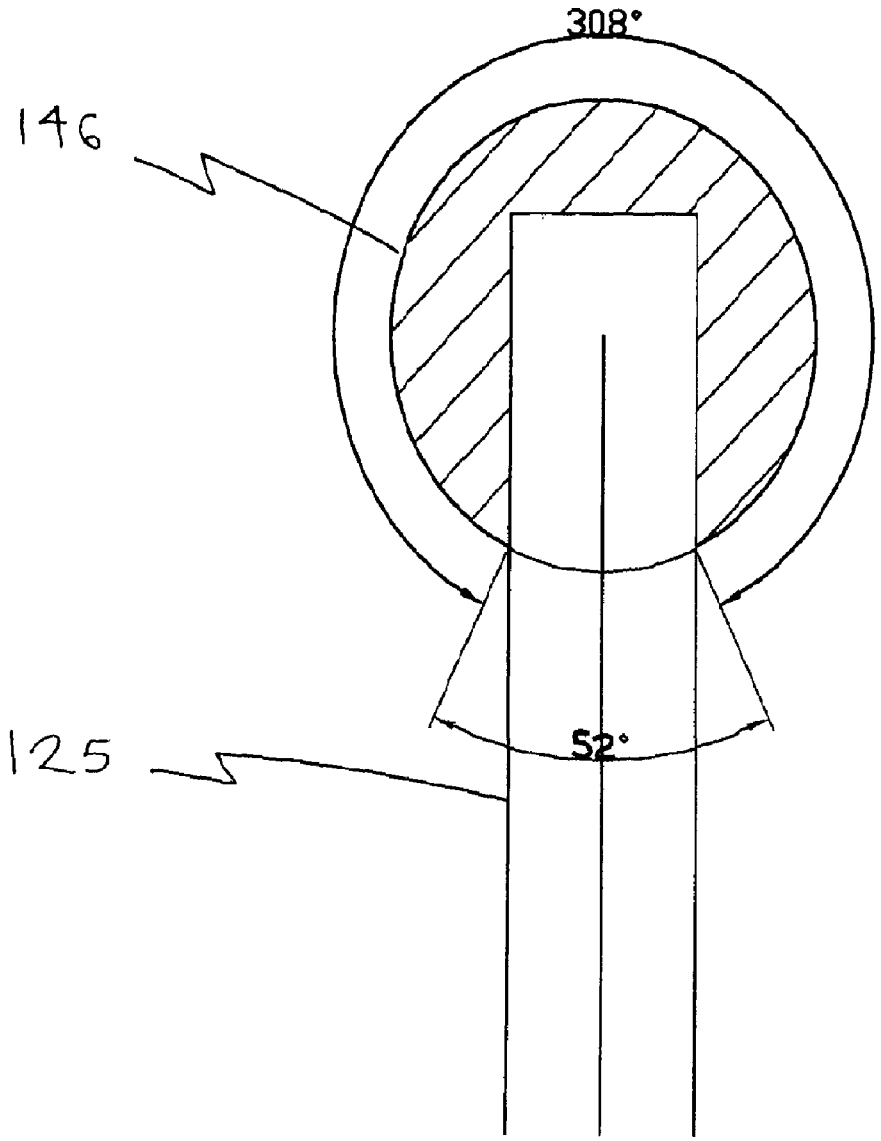
FIG. 10 is a schematic cross-section of a connector formed according to the present invention.

Referring now to FIG. 10 there is a shown a rail connector section 146 and a post 125 connected thereto.

The section 146 is generally cylindrical and the sector occupied by the post 125 is 52 degrees, leaving 308 degrees available for a user to grip across the post-rail connection region.

Figure 11:
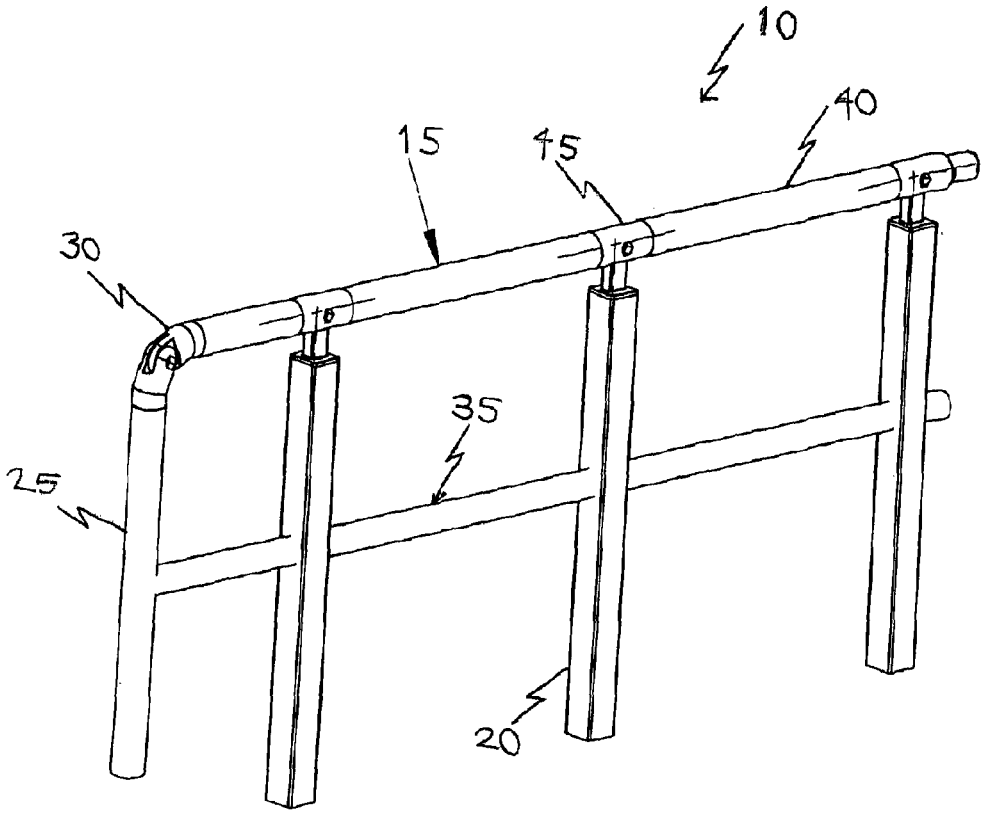
FIG. 11 is a perspective view of a hand rail arrangement including a connector formed according to an aspect of the present invention.
Figure 12:
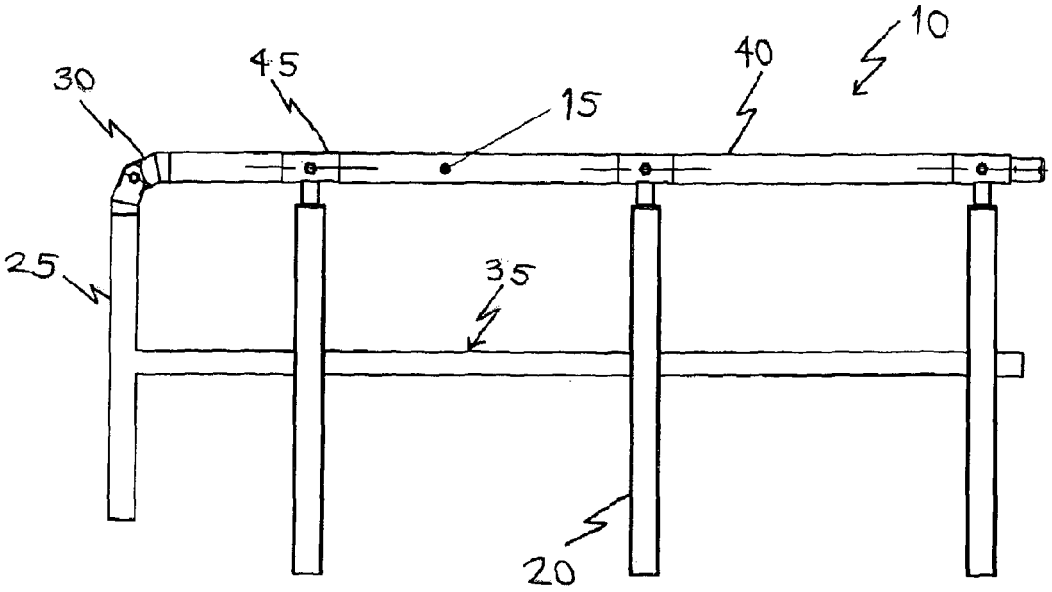
FIG. 12 is a side view of the arrangement of FIG. 11.

Referring now to FIGS. 11 and 12 there is shown a hand rail assembly generally indicated 10 formed according to an alternative aspect. The assembly 10 comprises a rectilinear top rail 15 and a plurality (in this case three are shown) of depending support posts 20. At one end of the rail 15 a support leg 25 is connected orthogonally by an articulating connector 30. A cross member 35 extends parallel to the top rail 15 from the leg 25 through the posts 20; in some embodiments the cross member 25 may comprise a plurality of sections extending between adjacent posts and between the leg 25 and the adjacent post 20.

The top rail 15 is of generally cylindrical shape with a circular cross section. The rail 15 is made up of a number of rail sections 40 which are joined by connectors 45 which also receive the post 20 as described in more detail below. Each post 20 is received on the underside of the connector 45 and the connectors 45 are the same diameter as the sections 40. This means that the connector 45 provides a surface which can itself be gripped by a user and the interface between the connector 45 and the adjacent rail sections 40 is such that a user does not need to remove their hand to pass over the intersections. Accordingly, the rail 15 presents a substantially continuous gripping surface along its length.

Referring now to FIGS. 13 to 26 the post-to-rail joint connector 45 is shown in more detail.

The connector 45 is generally T-shape and comprises a generally cylindrical rail connector part 46 and an elongate post connector part 70.

The rail connector part 46 comprises a central body 50 having at either end a cylindrical dowel portion 55, 56. The dowel portions 55, 56 are dimensioned to fit tightly within the ends of rail sections 40 and each dowel 55, 56 is provided with circumferential ribs 60 on their outer surfaces to centralise the fit to ensure a consistent adhesive line thickness.

The central section 50 includes a socket 65 having a generally rectangular cross section. The socket 65 is offset from the centre of the section 50 towards the dowel 55.

The socket 65 receives the post connector part 70.

The post connector part 70 comprises an articulation leg 75 received in the socket 65 and having a semi-circular end 76 with a fixing hole 77. The leg 75 extends to a post cap 80 from which depends a fixing section 85. The fixing section 85 has a generally square cross section and is provided on its external surface with a plurality of longitudinal ribs 90. The section 85 is received in the top of a post 20 and pushed in until the cap 80 abuts against the end of the post 20 in a flush fit.

In use the rail sections 40 are pushed onto the dowels 55, 56 until they abut against the central section 50. The central section 50 has the same cross section and diameter as the rail sections 40 so that there is a flush fit at the intersections.

The central section 50 is provided with a pin hole 95 and the leg 75 is also provided with a pin hole 77. The holes 95, 77 are aligned and a hinge pin 105 is passed through to join the leg 75 to the body 50 in a hinging joint.

Figure 13A:
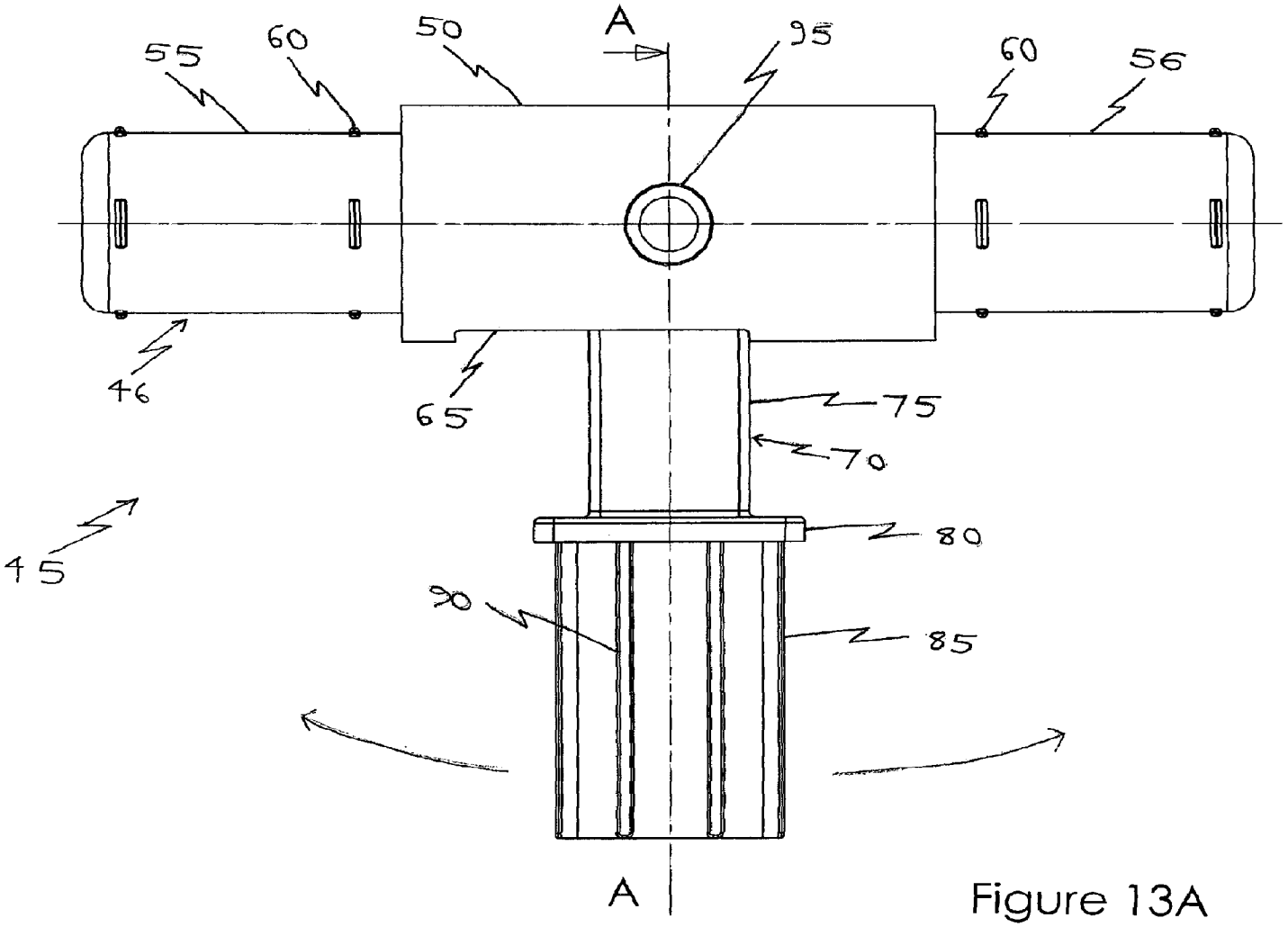
FIG. 13A is a side view of the connector of FIGS. 11 and 12 shown in a first position.
Figure 14:
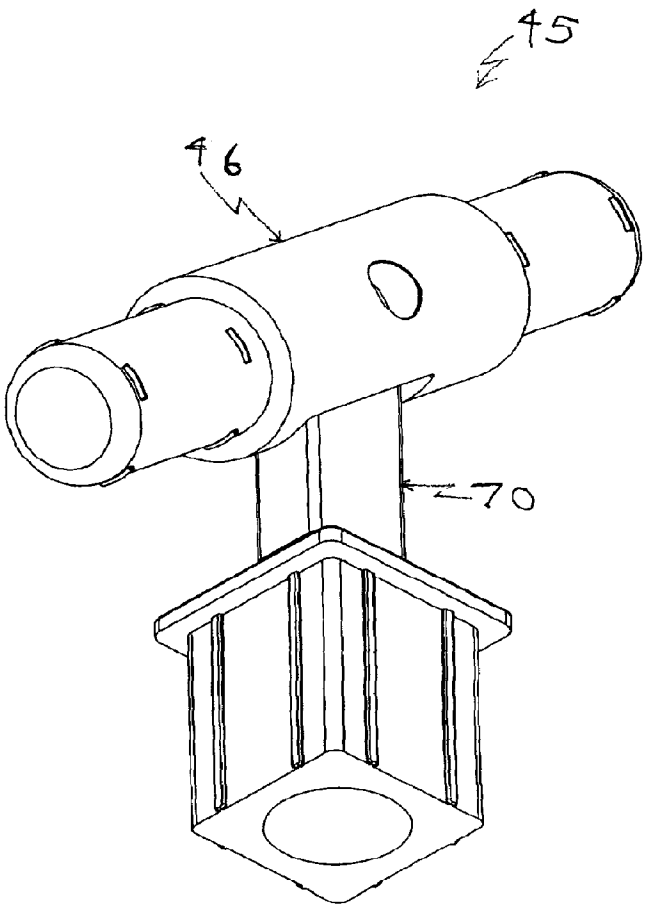
FIG. 14 is a an underside perspective view of the connector of FIGS. 13A and 13B.
Figure 13B:
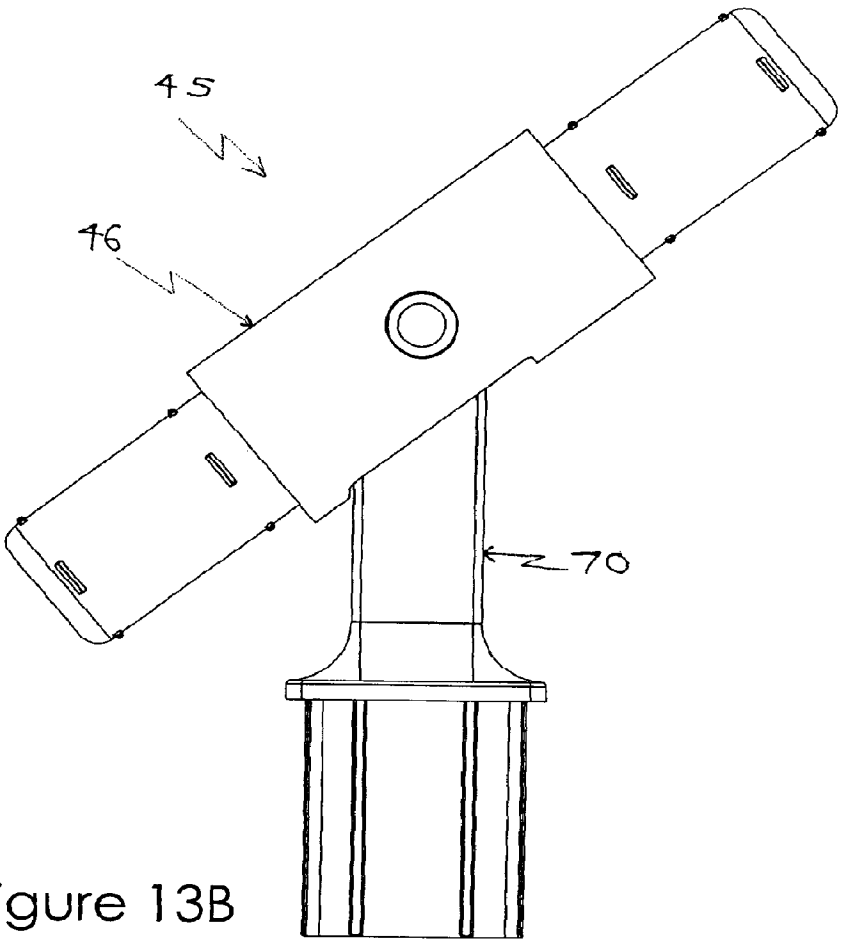
FIG. 13B is a side elevation of the connector of FIG. 13A shown in a second position.
Figure 15:
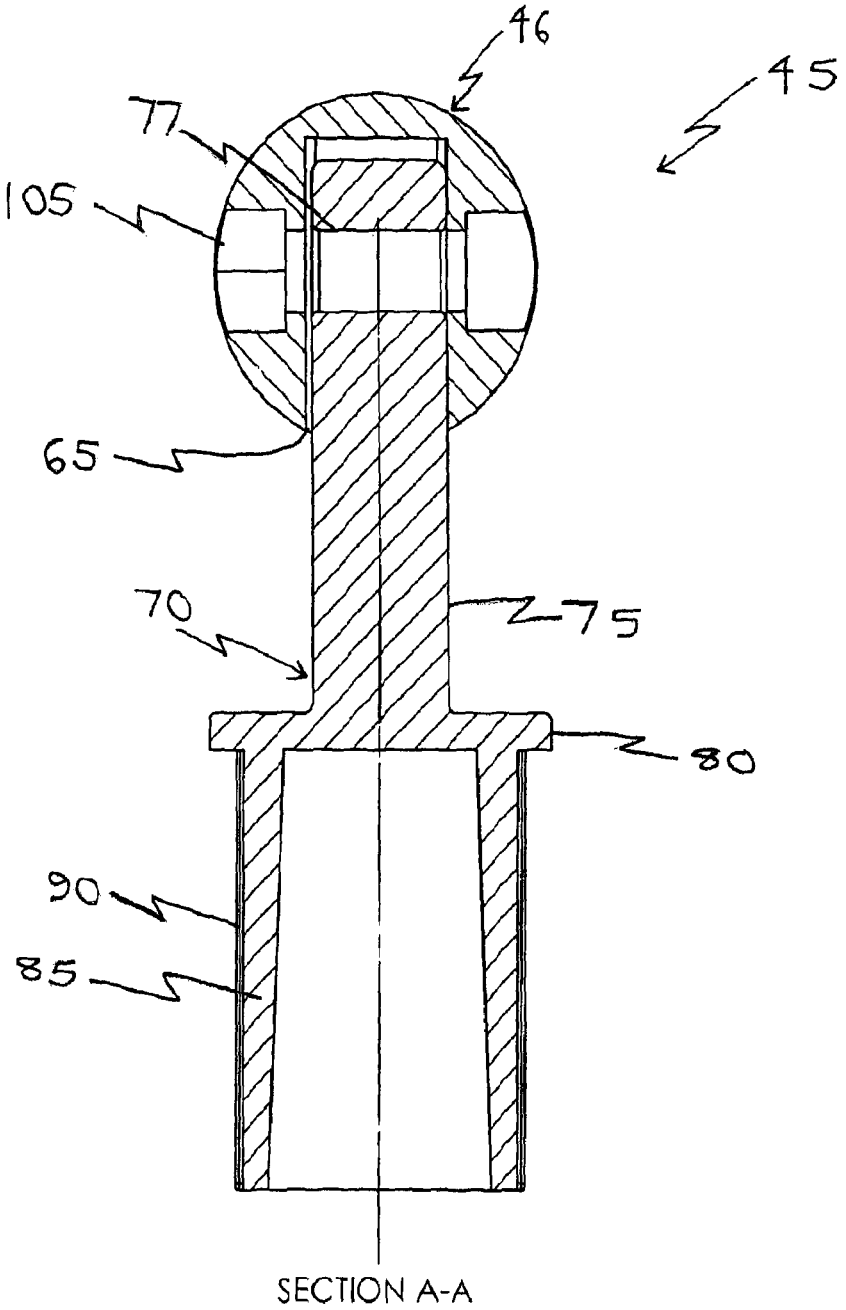
FIG. 15 is a section of the connection of FIG. 13A taken along line A-A.
Figure 16:
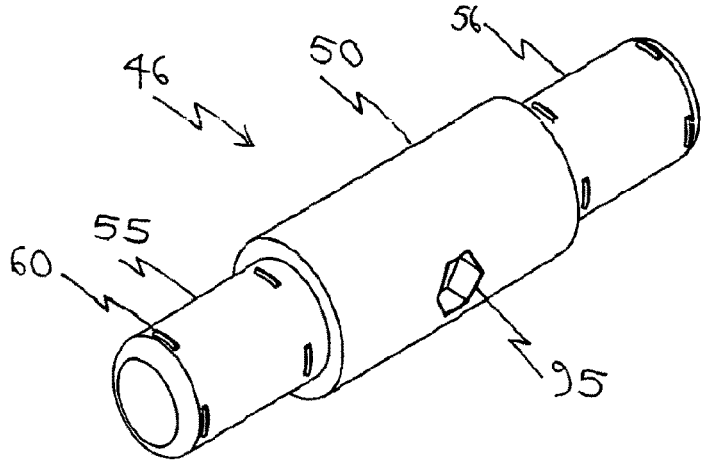
FIG. 16 is a perspective view of a rail connection part of the connector of FIGS. 13 to 15.
Figure 17:
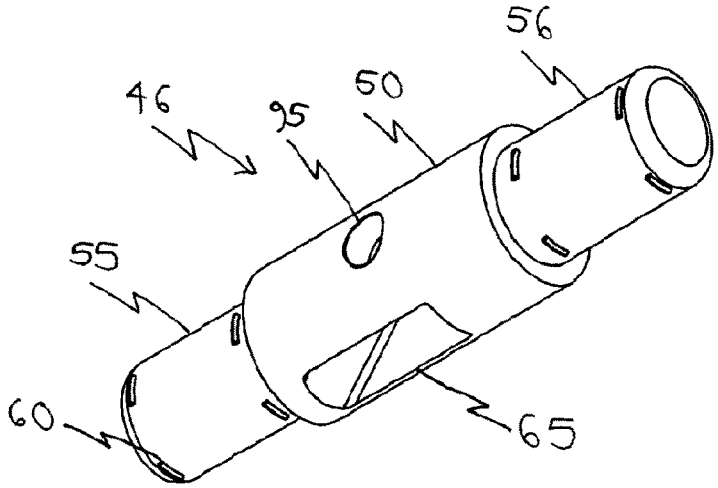
FIG. 17 is an alternative perspective view of the part of FIG. 16.
Figure 18:
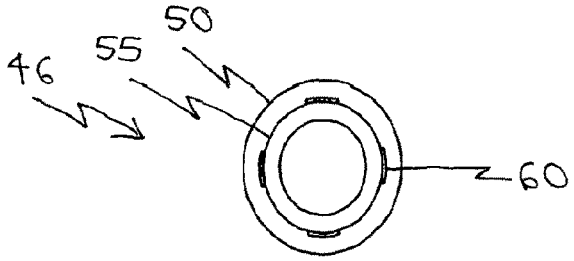
FIG. 18 is an end elevation of the part of FIG. 16.
Figure 19:
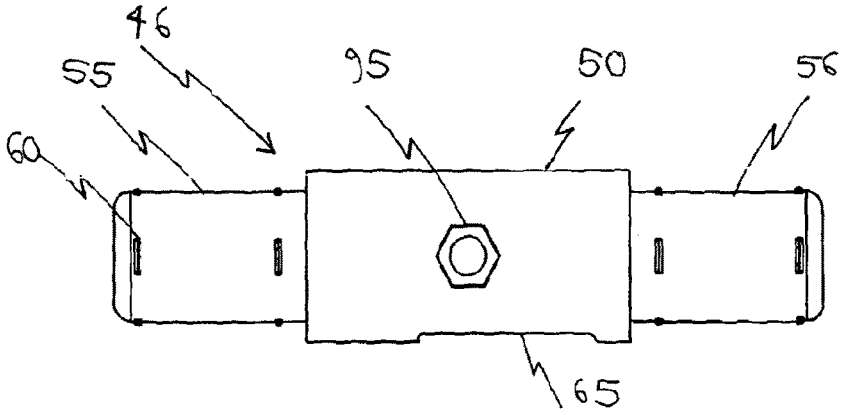
FIG. 19 is a side elevation of the part of FIG. 16.
Figure 20:
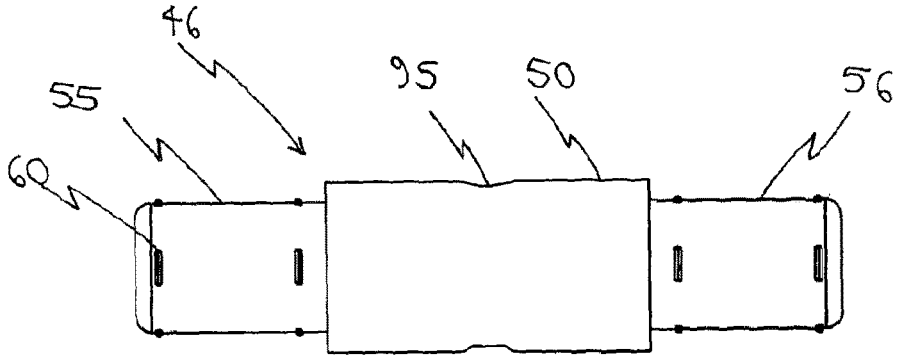
FIG. 20 is a plan view of the part of FIG. 16.
Figure 21:
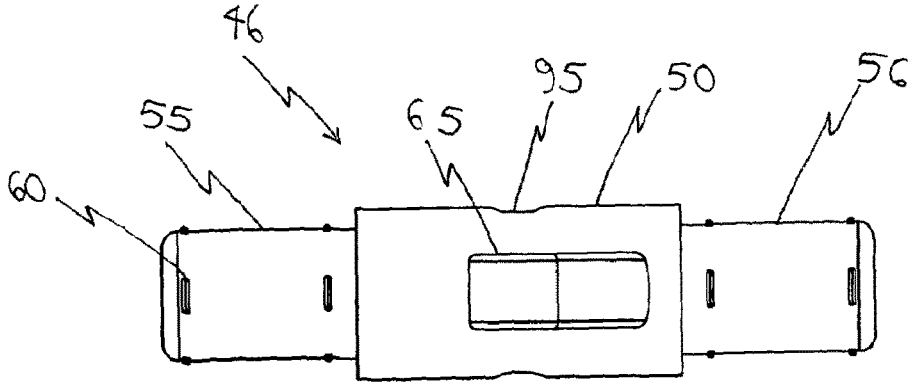
FIG. 21 is an underplan view of the part of FIG. 16.
Figure 22:
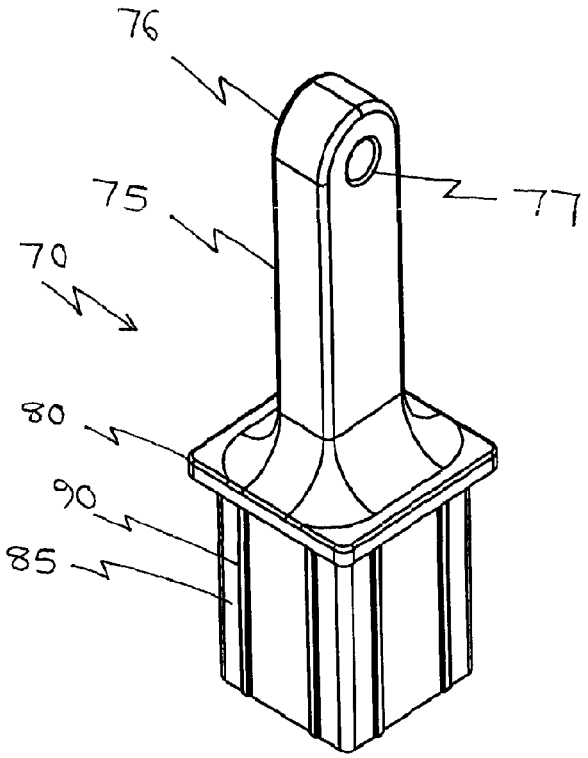
FIG. 22 is perspective view of a post connection part of the connector of FIGS. 13 to 15.
Figure 23:
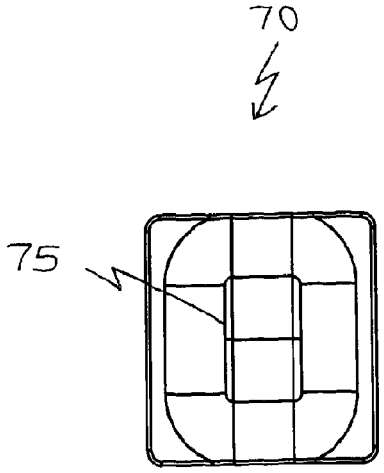
FIG. 23 is a plan view of the part of FIG. 22.
Figure 24:
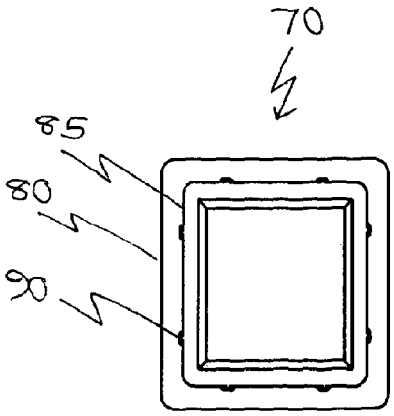
FIG. 24 is an underplan view of the part of FIG. 22.
Figure 26:
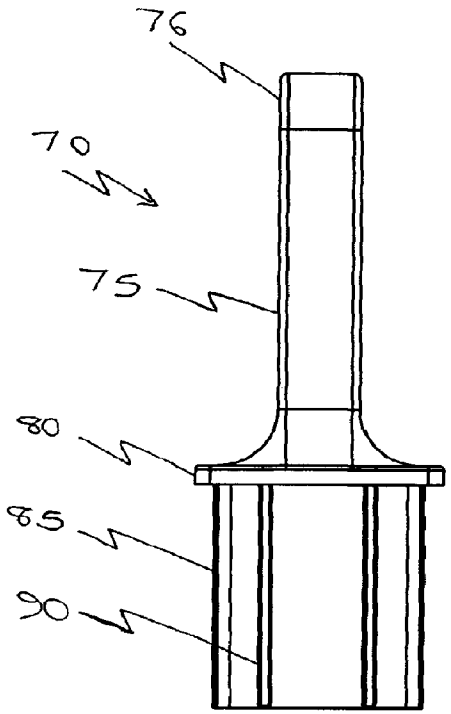
FIG. 26 is a side elevation of the part of FIG. 22.
Figure 25:
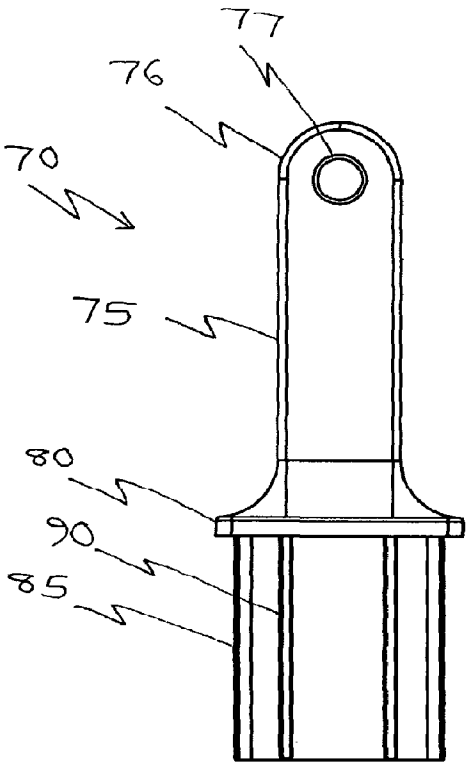
FIG. 25 is a front elevation of the part of FIG. 22.

This means that the joint between the body 50 and the leg 75 is articulated so that in use the angle between posts (via post connectors) and the hand rail can be varied as illustrated by FIGS. 13A and 13B to accommodate different situations.

Figure 27:
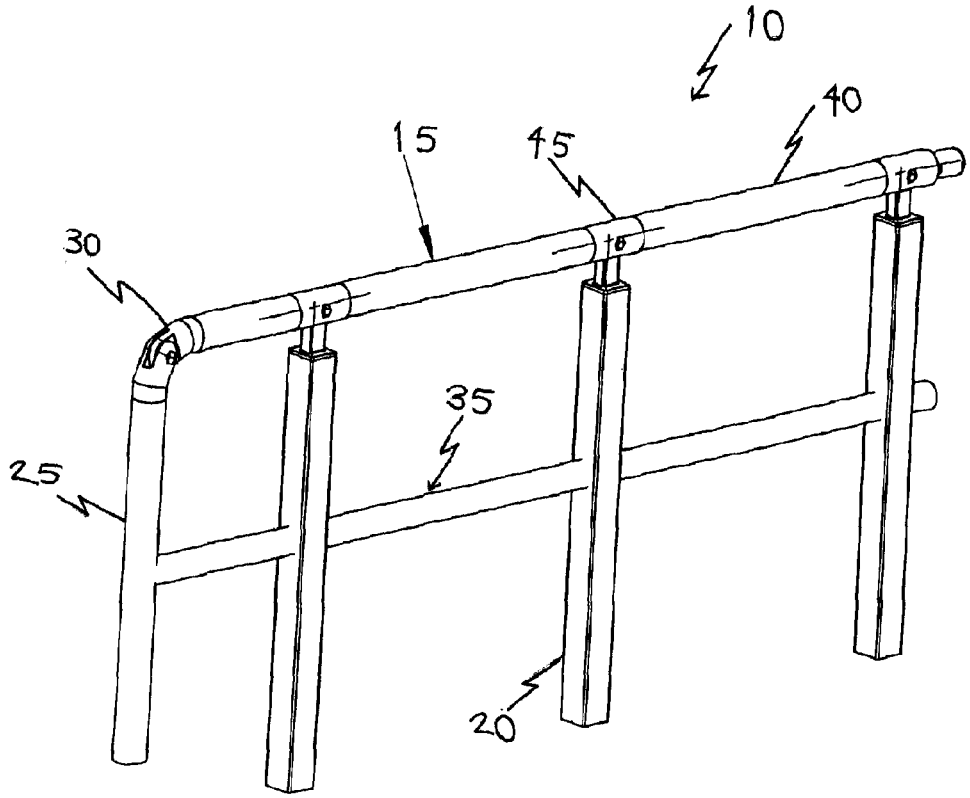
FIG. 27 is a perspective view of a hand rail arrangement formed with a connector according to an alternative aspect of the present invention.
Figure 28:
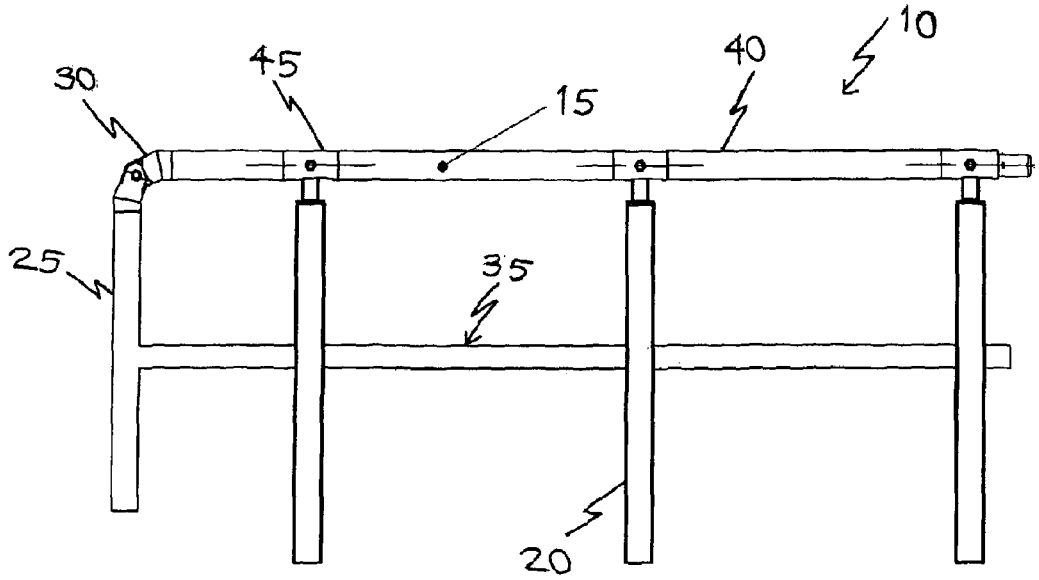
FIG. 28 is a side view of the arrangement of FIG. 27.

Referring now to FIGS. 27 and 28 there is shown a hand rail system generally indicated 10 formed according to an alternative aspect. The system 10 comprises a rectilinear top rail 15 and a plurality (in this case three are shown) of depending support posts 20. At one end of the rail 15 a support leg 25 is connected orthogonally by an articulating connector 30. A cross member 35 extends parallel to the top rail 15 from the leg 25 through the posts 20; in some embodiments the cross member 25 may comprise a plurality of sections extending between adjacent posts and between the leg 25 and the adjacent post 20.

The top rail 15 is of generally cylindrical shape with a circular cross section. The rail 15 is made up of a number of rail sections 40 which are joined by connectors 45 which also receive the post 20 as described in more detail below. Each post 20 is received on the underside of the connector 45 and the connectors 45 are the same diameter as the sections 40. This means that the connector 45 provides a surface which can itself be gripped by a user and the interface between the connector 45 and the adjacent rail sections 40 is such that a user does not need to remove their hand to pass over the intersections. Accordingly, the rail 15 presents a substantially continuous gripping surface along its length.

Figure 29:
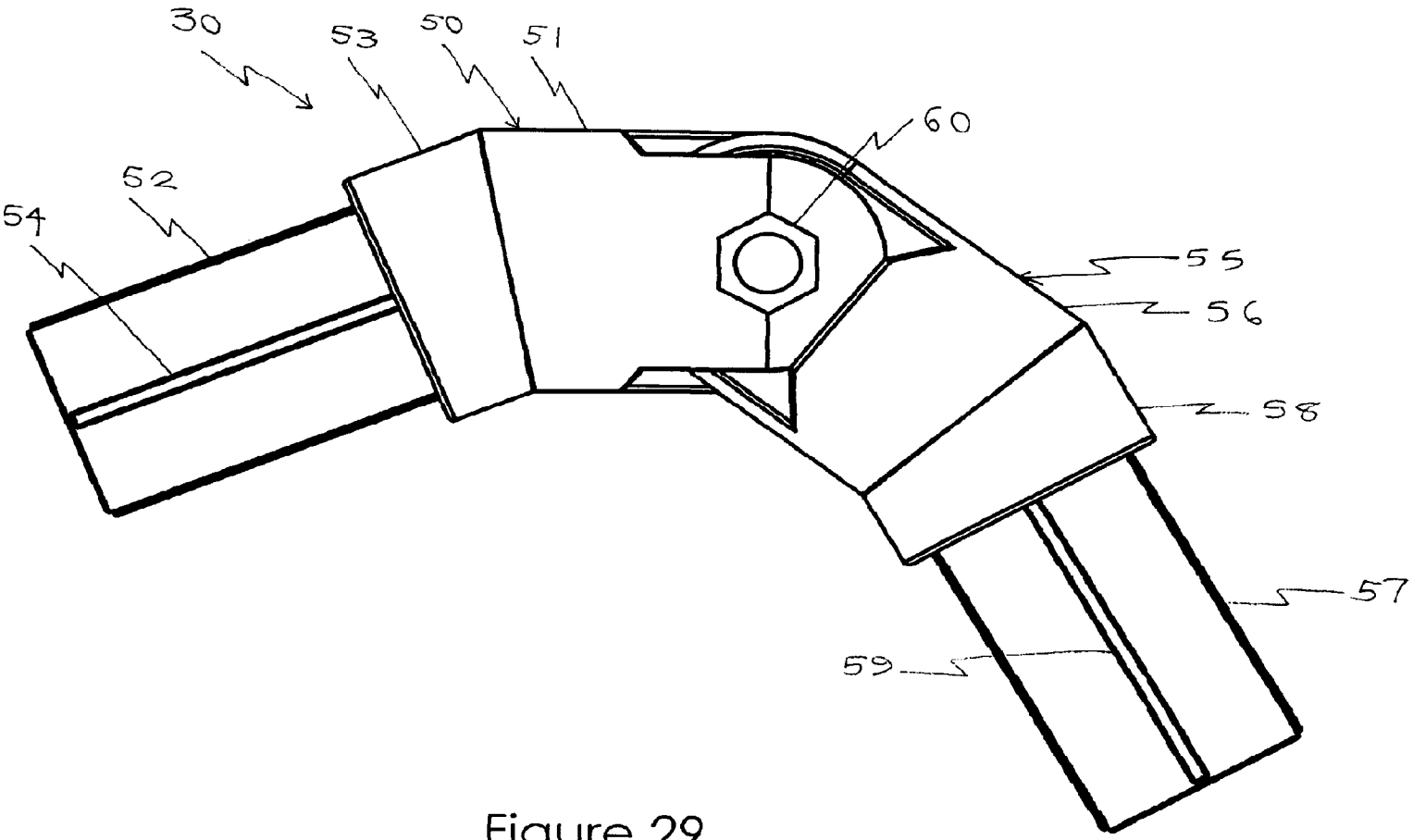
FIG. 29 is a side view of the connector.
Figure 30:
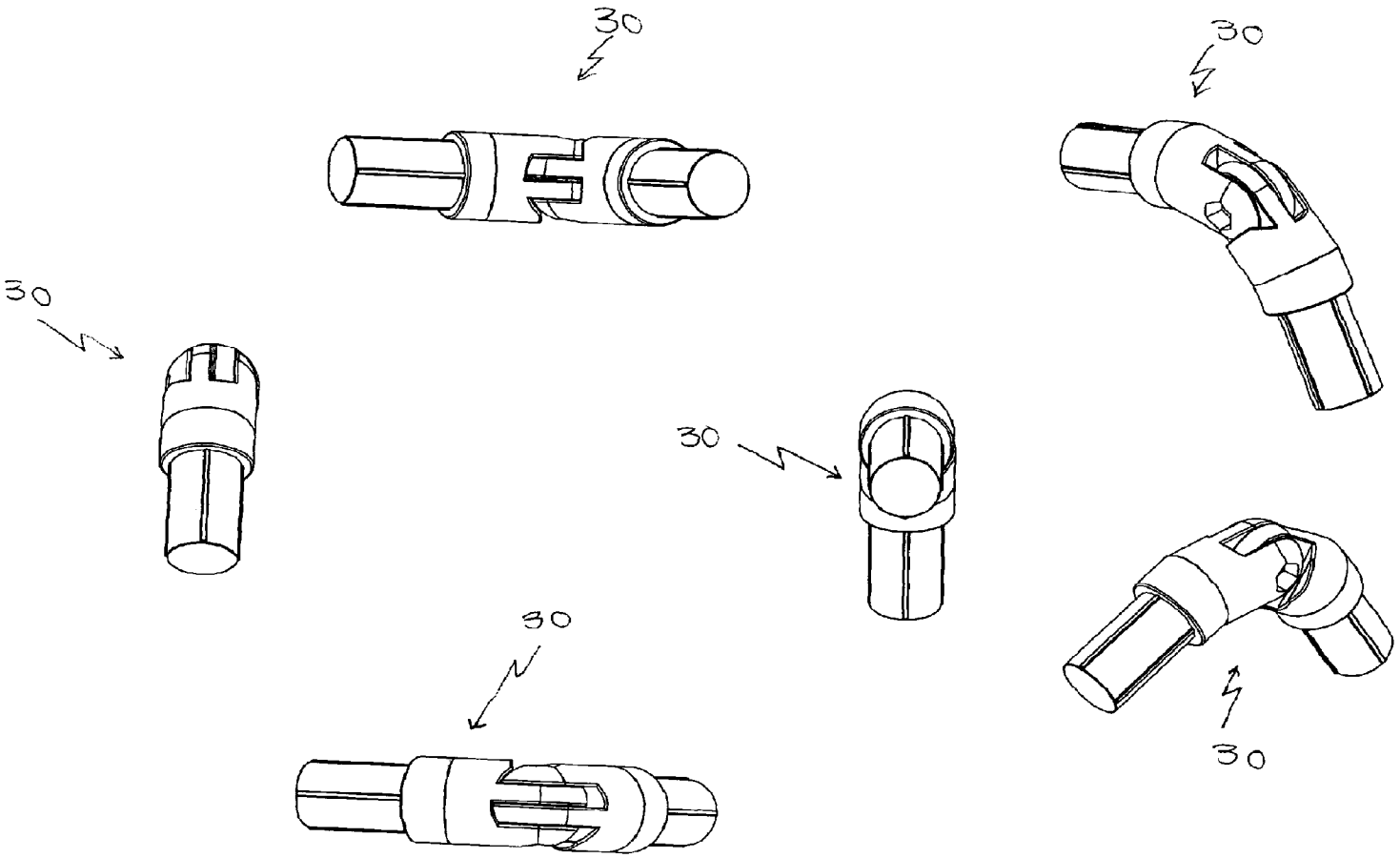
FIG. 30 shows top, bottom, front, rear and perspective views of the connector formed according to the present invention.

Referring now to FIGS. 29 and 30 the connector 30 is an articulated joint allowing the connection of adjacent rail sections and/or to connect rail to an end leg.

In this embodiment the connector 30 comprises two identical parts 50, 55 fitted together in a mirror-image arrangement.

As shown in more detail in FIGS. 31 to 35 each part 50, 55 (only part 50 is shown FIGS. 31 to 35) comprises an articulation section 51, 56 hingedly connected to each other by a hinge pin 60. Each part also comprises a dowel section 52, 57 dimensioned to be received in the end of a rail section or end post. The articulation sections 51, 56 are joined to the dowel sections 52, 57 by cranked sections 53, 58. The cranked sections 53, 58 effectively reduce the angle which can be created between the dowel sections 52, 57 thus "tightening" the joint angle. The connector is therefore particularly suited for tight spaces, such as stairwells, where tight turns between adjacent rail sections are required.

Each dowel section 52, 57 has a plurality of external longitudinal ribs or splines 54, 59 which help with fastening the parts onwardly to other hand rail components.

Figure 31:
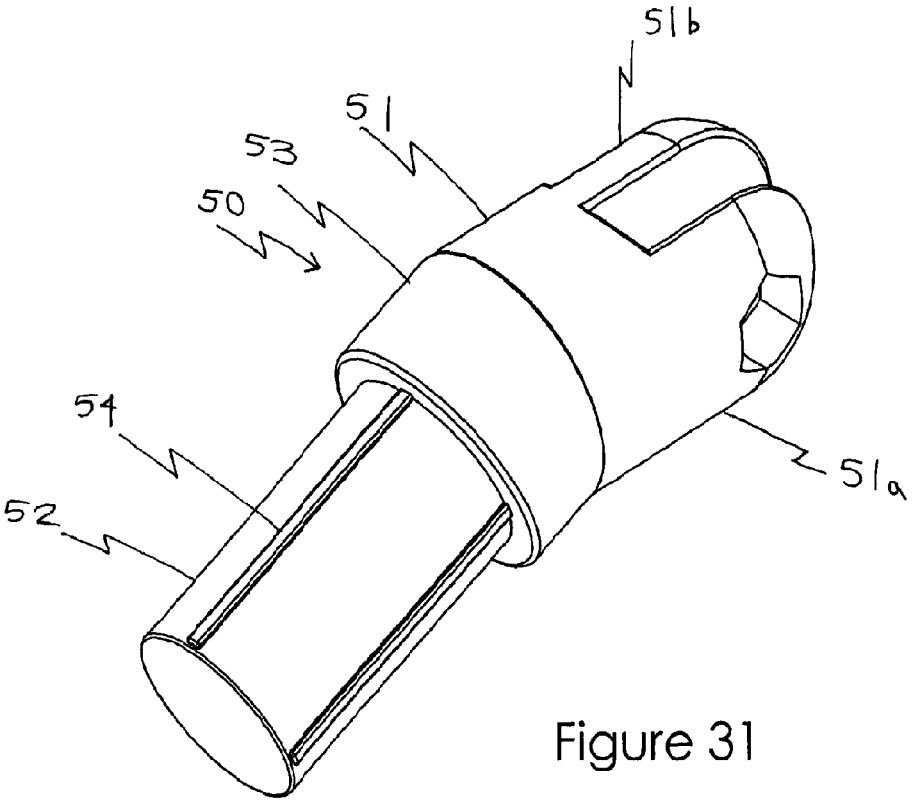
FIG. 31 is a perspective view of one part of the connector of FIGS. 29 and 30.
Figure 32:
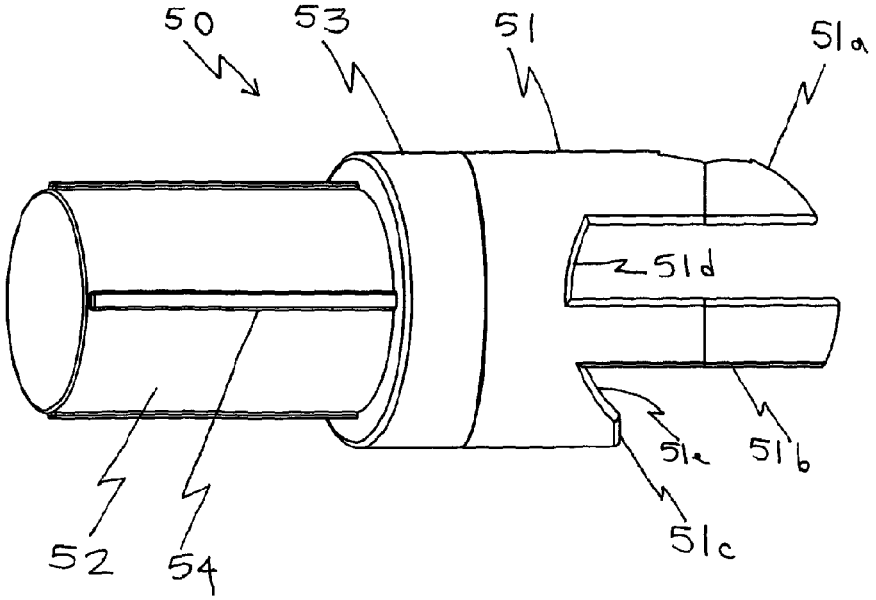
FIG. 32 is a plan view of the connector part of FIG. 31.
Figure 33:
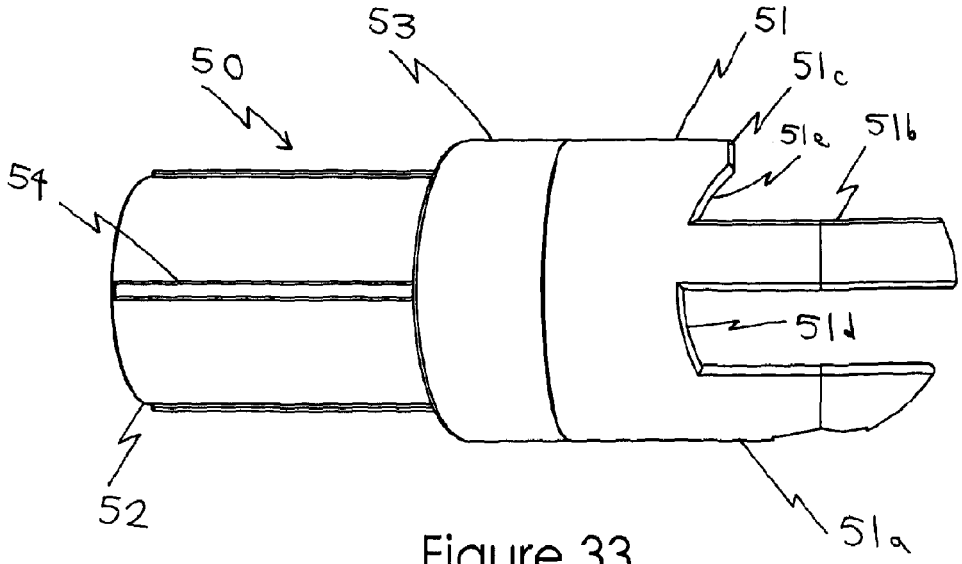
FIG. 33 is a plan view of the connector part of FIG. 31.
Figure 34:
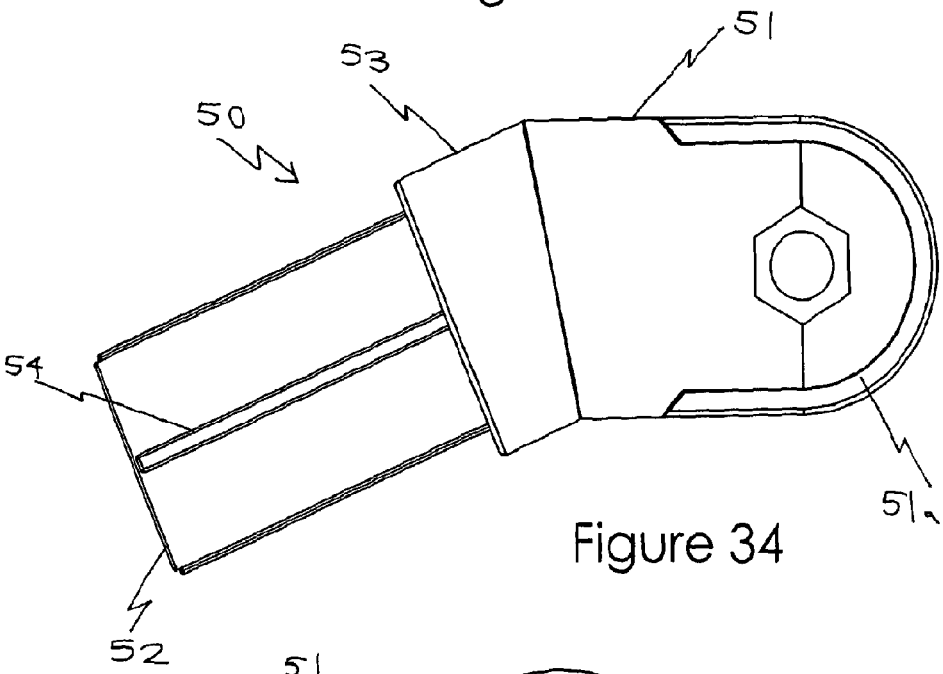
FIG. 34 is a side view of the connector part of FIG. 31.
Figure 35:
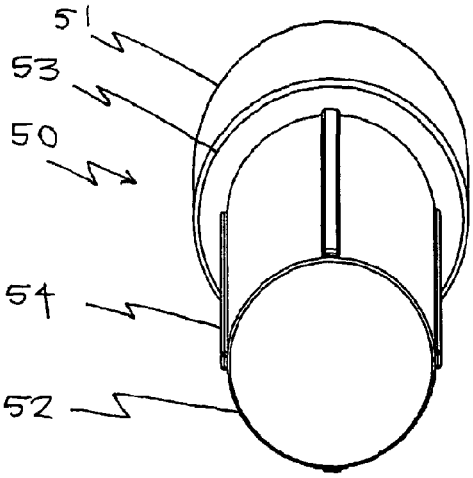
FIG. 35 is an end view of the connector part of FIG. 31.

As shown best in FIGS. 31 to 33, the articulation section 51 of the part 50 comprises two legs 51*a*, 51*b* and a claw 51*c* which together define a major and minor recess 51*d*, 51*e*. Because the part 55 is the same shape, when the two parts are brought together the legs of each part interdigitate into the legs and recesses of the other part. In this embodiment the crank angle provided by the sections 53, 58 is approximately 22.5° and allows the creation of a joint between adjacent rail sections of approximately 45°.

The connector could, of course, be used in conjunction with any hand rail system and is not restricted to the particular class or configuration of hand rail systems specifically described herein.

What is claimed is:

1. A handrail system comprising:

a top rail comprising a plurality of rail sections formed from a synthetic material;

one or more support posts formed from a synthetic material; and one or more connectors each formed from a synthetic material for connection to a respective one of the support posts and a respective pair of the rail sections, each connector comprising:

a rail connection part having a cylindrical central section and opposing connector sections being connected to the pair of rail sections at opposing axial ends thereof, the cylindrical central section forming a continuous part of the top rail with the rail sections, the cylindrical central section comprising a socket extending into an outer circumference thereof; and a post connection part for connection to the support post, the post connection part having an articulation leg, a post cap at an end of the articulation leg having a greater width than the articulation leg, and a fixing section extending from the post cap and connected to the support post, the post cap forming a flange extending outward from the fixing section and abutting an end of the support post; and a fastener hingedly connecting the articulation leg within the socket in an articulated configuration so that in use a slope of the top rail is adjustable, wherein a width of the socket defines a post-rail interface that occupies a circumferential area of the cylindrical central section that is less than a diameter of the cylindrical central section, and wherein the articulation leg extends a length away from the cylindrical central section such that the post cap is spaced from the cylindrical central section in a maximum articulated position, in which the articulation leg abuts an axial edge of the socket, to provide a continuous gripping surface of the top rail that can be gripped by a user such that a user does not need to remove their hand to pass over the post-rail interface.

2. The system as claimed in claim 1, in which each rail section of the top rail is formed from a phenolic-based FRP material.

3. The system as claimed in claim 1, in which each support post is formed from a phenolic-based FRP material.

4. The system as claimed in claim 1, in which each connector is formed from a phenolic-based FRP material.

5. The system as claimed in claim 1, in which each connector is substantially T-shaped.

6. The system as claimed in claim 1, in which the post connection part is formed separately from the rail connection part.

7. The system as claimed in claim 1, in which the cylindrical central section has a circular cross-sectional shape.

8. The system as claimed in claim 7, in which a sector of the rail connection part occupied by the post-rail interface is in a range of 40 to 60 degrees.

9. The system as claimed in claim 8, in which a sector of the rail connection part occupied by the post-rail interface is approximately 52 degrees, leaving approximately 308 degrees available for a user to grip across the post-rail interface.

10. The system as claimed in claim 1, in which the rail connection part is flush fitting with the pair of rail sections.

11. The system as claimed in claim 1, further comprising a cross member extending parallel to the top rail and connected to the one or more support posts, in which the top rail is of generally cylindrical shape with a circular cross section, and the cylindrical central section of each of the one or more connectors has a same diameter as the rail sections connected thereto.

12. The system as claimed in claim 1, in which the system comprises one or more adjustable corner connectors including first and second parts hingedly connected to each other and being attachable to one of the rail sections and to one of the support posts or a leg, the first and/or second part comprising a cranked portion.

13. The system as claimed in claim 12, in which each corner connector is formed from a phenolic-based FRP material.

14. The system as claimed in claim 12, in which the first and second parts of each corner connector are substantially the same.

15. The system as claimed in claim 12, in which first and second parts of the one or more adjustable corner connectors have a crank angle in a range of 15 to 30 degrees.

16. A method of forming the system as claimed in claim 12, comprising the step of forming the rail sections and the one or more support posts from the synthetic material, in which the rail sections of the top rail are formed by pultrusion.

17. The method of claim 16, further comprising the step of molding the one or more connectors formed from the synthetic material.

18. The method of claim 17, further comprising the step of molding the one or more adjustable corner connectors including the first and second parts.

19. The system as claimed in claim 1, wherein the fastener comprises a pin.

* * * * *